US012655560B2

(12) United States Patent
Park et al.

(10) Patent No.: US 12,655,560 B2
(45) Date of Patent: Jun. 16, 2026

(54) WASHING MACHINE AND METHOD OF CONTROLLING THE SAME

(71) Applicant: SAMSUNG ELECTRONICS CO., LTD., Suwon-si (KR)

(72) Inventors: Sukwoo Park, Suwon-si (KR); Minjoo Kim, Suwon-si (KR); Changju Oh, Suwon-si (KR); Sangyeol Lee, Suwon-si (KR); Jaepoong Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 77 days.

(21) Appl. No.: 18/389,065

(22) Filed: Nov. 13, 2023

(65) Prior Publication Data

US 2024/0183095 A1 Jun. 6, 2024

Related U.S. Application Data

(63) Continuation of application No. PCT/KR2023/015573, filed on Oct. 11, 2023.

(30) Foreign Application Priority Data

Dec. 2, 2022 (KR) ..... 10-2022-0166778

(51) Int. Cl.
*D06F 34/18* (2020.01)
*D06F 13/02* (2006.01)
(Continued)

(52) U.S. Cl.
CPC ..... *D06F 33/32* (2020.02); *D06F 13/02* (2013.01); *D06F 34/05* (2020.02); *D06F 34/18* (2020.02);
(Continued)

(58) Field of Classification Search
None
See application file for complete search history.

(56) References Cited

U.S. PATENT DOCUMENTS 5,561,990 A 10/1996 Berkcan et al.
2019/0169780 A1* 6/2019 Chen ..... G05B 19/0426
(Continued)

FOREIGN PATENT DOCUMENTS

AU 703923 B2 1/1997
EP 0 415 743 B1 10/1995
(Continued)

OTHER PUBLICATIONS

International Search Report dated Jan. 22, 2024 issued in PCT Application No. PCT/KR2023/015573.
(Continued)

*Primary Examiner* — Cristi J Tate-Sims
(74) *Attorney, Agent, or Firm* — STAAS & HALSEY LLP

(57) ABSTRACT

A washing machine includes a tub; a rotating tub rotatably provided in the tub; a pulsator rotatably provided in a lower portion of the rotating tub; a washing rod configured to be coupled to the pulsator; a sensor configured to detect coupling or decoupling of the washing rod and the pulsator; a control panel configured to display a plurality of washing modes; and a controller configured to be electrically connected to the sensor and the control panel, wherein the controller is configured to identify whether the pulsator and the washing rod are coupled based on a detection signal of the sensor, and control the control panel to display at least one washing mode corresponding to a coupled state of the washing rod or a decoupled state of the washing rod among the plurality of washing modes.

20 Claims, 16 Drawing Sheets

(51) Int. Cl.

| | |
|---|---|
| ***D06F 33/32*** | (2020.01) |
| ***D06F 34/05*** | (2020.01) |
| ***D06F 34/20*** | (2020.01) |
| ***D06F 34/32*** | (2020.01) |
| *D06F 103/68* | (2020.01) |
| *D06F 105/46* | (2020.01) |
| *D06F 105/58* | (2020.01) |

(52) U.S. Cl.
CPC ..... *D06F 34/20* (2020.02); *D06F 34/32* (2020.02); *D06F 2103/68* (2020.02); *D06F 2105/46* (2020.02); *D06F 2105/58* (2020.02)

(56) References Cited

U.S. PATENT DOCUMENTS

| | | | | |
|---|---|---|---|---|
| 2020/0399811 | A1* | 12/2020 | Czarnecki ..... | D06F 37/12 |
| 2022/0243379 | A1* | 8/2022 | Adkins ..... | D06F 37/40 |

FOREIGN PATENT DOCUMENTS

| | | |
|---|---|---|
| JP | 2018-175901 | 11/2018 |
| KR | 1995-023319 | 8/1995 |
| KR | 20-1997-0039208 | 7/1997 |
| KR | 10-0205433 | 7/1999 |
| KR | 20-2000-0009523 | 6/2000 |
| KR | 2002-0006803 | 1/2002 |
| KR | 10-0332823 | 9/2002 |
| KR | 20-0298580 | 12/2002 |
| KR | 10-0395255 | 8/2003 |
| KR | 10-2005-0050290 | 5/2005 |
| KR | 10-2019-0054336 | 5/2019 |

OTHER PUBLICATIONS

Written Opinion dated Jan. 22, 2024 issued in PCT Application No. PCT/KR2023/015573.
Extended European Search Report dated Aug. 29, 2025 for corresponding European Application No. 23898054.4.

* cited by examiner

WASHING MACHINE AND METHOD OF CONTROLLING THE SAME

CROSS-REFERENCE TO RELATED APPLICATIONS

This application is a continuation application, under 35 U.S.C. § 111(a), of International Patent Application No. PCT/KR2023/015573, filed on Oct. 11, 2023, which claims the priority benefit of Korean Patent Application No. 10-2022-0166778, filed on Dec. 2, 2022 in the Korean Patent and Trademark Office, the disclosures of which are hereby incorporated by reference in their entirety.

TECHNICAL FIELD

The disclosure relates to a washing machine capable of providing various washing modes for washing laundry, and a method of controlling the same.

BACKGROUND ART

Washing machines are devices for washing laundry by rotating their cylindrical rotating tub. In general, washing machines are divided into two types of washing machines: a washing machine that washes laundry by rotating a rotating tub with a horizontal axis as an axis of rotation so that the laundry is raised up and dropped off along an inner wall of the rotating tub, and a washing machine that rotates a rotating tub with a vertical axis as an axis of rotation and washes laundry by using the water current generated by a pulsator.

The washing machine having a horizontal rotation axis is referred to as a front-loading washing machine, because a laundry inlet is formed at the front, and the washing machine having a vertical rotation axis is referred to as a top-loading washing machine, because a laundry inlet is formed at the top. In addition, washing machines including a plurality of washing apparatuses driven by different manners exist to take advantage of the two types described above.

In order to wash laundry, a washing machine performs a washing operation for removing contamination of laundry with water (particularly, washing water) in which detergent is dissolved, a rinsing operation for rinsing the laundry with water (particularly, rinsing water) containing no detergent, and a dehydrating operation for removing moisture contained in the laundry by high-speed rotation.

Meanwhile, a top-loading washing machine may include a washing rod mounted to a pulsator. The washing rod may be referred to as an agitator. The washing rod may facilitate the generation of water flow and friction with the laundry to improve washing efficiency. However, a large amount of laundry may not be loaded when the pulsator is coupled to the washing rod.

DISCLOSURE

Technical Problem

Therefore, it is an aspect of the disclosure to provide a washing machine capable of guiding to use a suitable washing mode in response to coupling or decoupling of a pulsator and a washing rod, and a method of controlling the same.

Technical objects that can be achieved by the disclosure are not limited to the above-mentioned those, and other technical objects not mentioned will be clearly understood by one of ordinary skill in the technical art to which the disclosure belongs from the following description.

Technical Solution

In accordance with an aspect of the disclosure, a washing machine may include: a tub; a rotating tub configured to be rotatable in the tub; a pulsator configured to be rotatable in a lower portion of the rotating tub; a washing rod configured to be coupled to the pulsator; a sensor configured to detect coupling or decoupling of the washing rod to the pulsator, and to transmit a detection signal based on the coupling or the decoupling of the washing rod to the pulsator; a control panel configured to display a plurality of washing modes; and a controller configured to be electrically connected to the sensor and the control panel, wherein the controller may be configured to control the control panel to display at least one washing mode corresponding to a coupled state of the washing rod or a decoupled state of the washing rod among the plurality of washing modes based on the transmitted detection signal from the sensor.

The controller may be configured to control the control panel to identifiably display at least one first washing mode that requires a use of the washing rod, based on the transmitted detection signal from the sensor.

The controller may be configured to control the control panel to display guide information that recommends the decoupling of the washing rod, based on a second washing mode that does not require the use of the washing rod being selected by a user input, in the coupled state of the washing rod.

The controller may be configured to control the control panel to display other washing modes other than at least one first washing mode among the plurality of washing modes that requires a use of the washing rod, based on the decoupled state of the washing rod.

The controller may be configured to control the control panel to display guide information that recommends the coupling of the washing rod, based on one of the at least one first washing mode being selected by a user, in the decoupled state of the washing rod.

The controller may be configured to: detect a weight of laundry accommodated in the rotating tub, based on an input of an execution command of a washing mode executable in both the coupled state of the washing rod and the decoupled state of the washing rod from among the at least one washing mode, and control the control panel to display first guide information that recommends the decoupling of the washing rod or second guide information that recommends the coupling of the washing rod, based on the detected weight of the laundry.

The controller may be configured to control the control panel to display the first guide information, based on the detected weight of the laundry detected in the coupled state of the washing rod exceeding a predetermined reference level.

The controller may be configured to control the control panel to display the second guide information, based on the detected weight of the laundry detected in the decoupled state of the washing rod being equal to or less than a predetermined reference level.

The washing machine may further include a motor configured to rotate the rotating tub, wherein the controller may be configured to control the motor so that the rotating tub rotates to move the laundry to a side wall of the rotating tub, based on the coupling or the decoupling of the washing rod being determined based on the weight of the laundry.

The washing machine may further include a communication interface configured to communicate with an external mobile device, wherein the controller may be configured to control the communication interface to transmit display information about the at least one washing mode to the external mobile device.

The washing rod may includes an identifier, and the sensor may detect the coupling or decoupling of the washing rod to the pulsator based on the detection of the identifier.

The identifier may include a magnet, the sensor may include a magnet sensor to detect a magnetic force generated by the magnet of the pulsator, and in response to detecting the generated magnetic force, the sensor may be configured to transmit the detection signal to the controller.

The sensor may include a light sensor emits a light and receives the light reflected from the identifier, and in response to detecting the reflected light, the sensor may be configured to transmit the detection signal to the controller.

In accordance with an aspect of the disclosure, a method of controlling a washing machine including a control panel configured to display a plurality of washing modes may include: detecting, by a sensor, coupling or decoupling of a washing rod and a pulsator using a sensor; transmitting, by the sensor, a detection signal to a controller based on the coupling or the decoupling of the washing rod to the pulsator; and controlling, by the controller, the control panel to display at least one washing mode corresponding to a coupled state of the washing rod or a decoupled state of the washing rod among the plurality of washing modes based on the transmitted detection signal.

The controlling of the control panel may include identifiably displaying at least one first washing mode related to a use of the washing rod, based on transmitting of the detection signal.

The controlling of the control panel may further include displaying guide information that recommends decoupling of the washing rod, based on a second washing mode which does not requires the use of the washing rod being selected by a user, in the coupled state of the washing rod.

The controlling of the control panel may include displaying other washing modes other than at least one first washing mode that requires a use of the washing rod, based on the decoupled state of the washing rod.

The controlling of the control panel may further include displaying guide information that recommends coupling of the washing rod, based on one of the at least one first washing mode being selected by a user, in the decoupled state of the washing rod.

The method may further include: detecting a weight of laundry accommodated in a rotating tub, based on an input of an execution command of a washing mode executable in both the coupled state of the washing rod and the decoupled state of the washing rod from among the at least one washing mode, wherein the controlling of the control panel may further include displaying first guide information that recommends decoupling of the washing rod or second guide information that recommends coupling of the washing rod, based on the weight of the laundry.

The controlling of the control panel may include displaying the first guide information, based on the weight of the laundry detected in the coupled state of the washing rod exceeding a predetermined reference level.

The controlling of the control panel may include displaying the second guide information, based on the weight of the laundry detected in the decoupled state of the washing rod being equal to or less than a predetermined reference level.

The method may further include controlling a motor so that the rotating tub rotates to move the laundry to a side wall of the rotating tub, based on coupling or decoupling of the washing rod being determined based on the weight of the laundry.

The method may further include controlling a communication interface to transmit display information about the at least one washing mode to an external mobile device.

Advantageous Effects

The disclosed washing machine and the method of controlling the same can guide a user to use a suitable washing mode in response to coupling or decoupling of a pulsator and a washing rod.

The disclosed washing machine and the method of controlling the same can set a washing mode suitable for a coupled state or a decoupled state of a pulsator and a washing rod, and guide a user on coupling or decoupling of the washing rod according to selection of a washing mode. Thus, convenience of use of the washing machine and a washing efficiency can be improved.

MODES OF THE INVENTION

Figure 1:
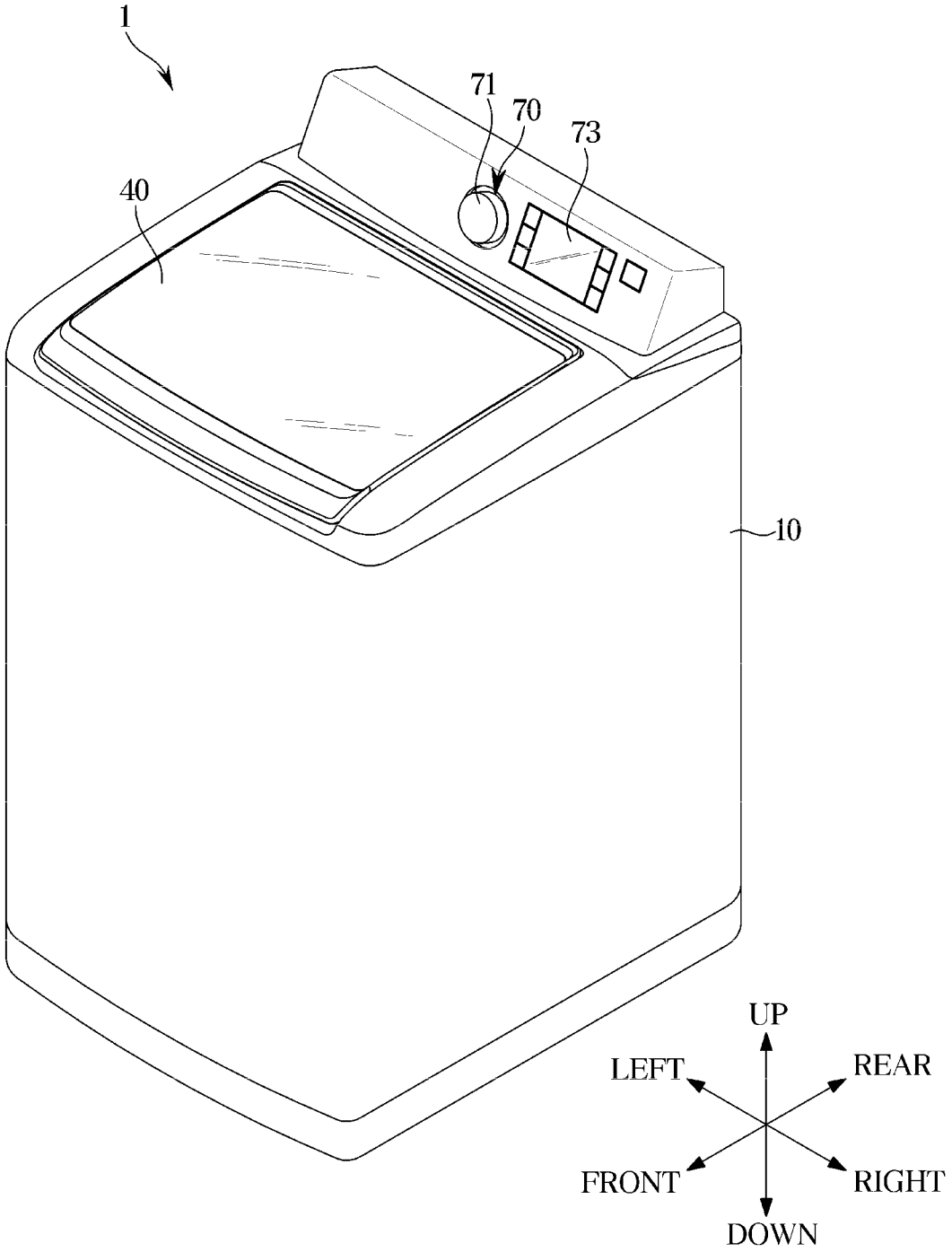
FIG. 1 is a perspective view of a washing machine according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

It will be understood that when an element is referred to as being "connected" to another element, it can be directly or indirectly connected to the other element, wherein the indirect connection includes "connection" via a wireless communication network or electrically through electrical wiring.

The terminology used herein is for the purpose of describing particular embodiments only and is not intended to limit the disclosure. It is to be understood that the singular forms include plural forms as well, unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. For example, without departing from the technical spirit or essential features of the disclosure, a first element may be referred to as a second element, and also a second element may be referred to as a first element.

In addition, the terms "portion", "device", "block", "member", and "module" used herein refer to a unit for processing at least one function or operation. For example, the terms may mean at least one process that may be processed by at least one hardware such as field-programmable gate array (FPGA) or application specific integrated circuit (ASIC), or at least one software or processor stored in a memory.

Reference numerals used for method steps are just used for convenience of explanation, but not to limit an order of the steps. Thus, unless the context clearly dictates otherwise, the written order may be practiced otherwise.

Hereinafter, embodiments of the disclosure will be described in detail with reference to the accompanying drawings.

Figure 2:
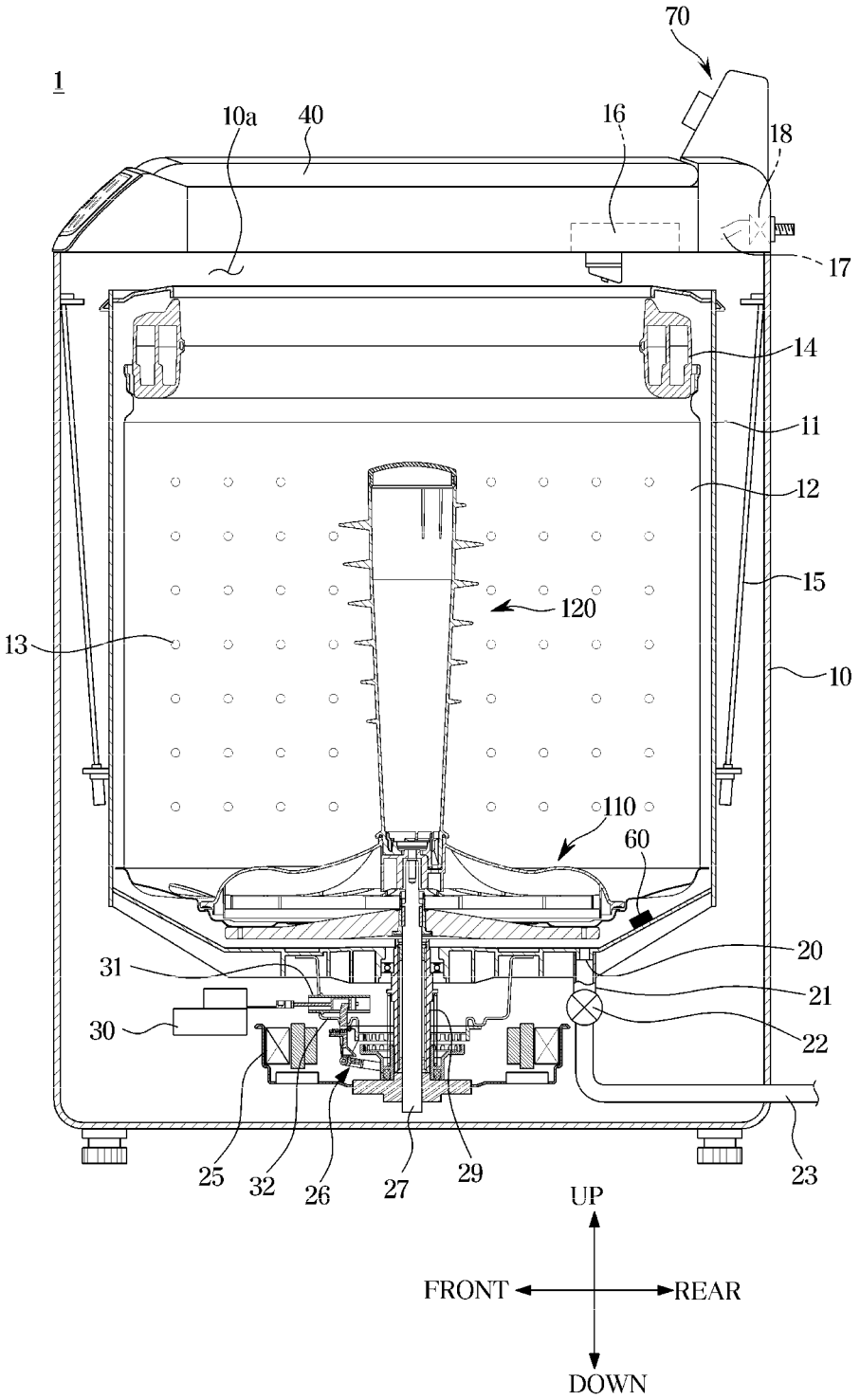
FIG. 2 illustrates a cross-sectional view of the washing machine illustrated in FIG. 1.

FIG. 1 is a perspective view of a washing machine according to an embodiment of the disclosure. FIG. 2 illustrates a cross-sectional view of the washing machine illustrated in FIG. 1.

Referring to FIG. 1, a side on which a door 40 of a washing machine 1 is disposed is referred to as an upper side, and a side opposite to the upper side is referred to as a lower side. In addition, a side where the door 40 of the washing machine 1 opens is referred to as a front side, and an opposite side is referred to as a rear side. Furthermore, a left side of the front side is referred to as a left side and a right side of the front side is referred to as a right side.

The washing machine 1 may include a control panel 70 disposed on an upper portion of a cabinet 10. The control panel 70 may obtain a user input regarding an operation of the washing machine 1 from a user. Also, the control panel 70 may display information about the operation of the washing machine 1. For example, the control panel 70 may include a dial 71 and a display 73. The control panel 70 may also include a plurality of buttons and/or a touch screen. The control panel 70 is described in more detail with reference to FIG. 6.

Referring to FIG. 2, the washing machine 1 may include a tub 11 disposed inside the cabinet 10 to store laundry water, a rotating tub 12 rotatably disposed inside the tub 11, and a pulsator 110 disposed at a bottom of the rotating tub 12 to generate water flow. The pulsator 110 may be coupled to a washing rod 120. The washing rod 120 may be referred to as an agitator.

The cabinet 10 forms an exterior of the washing machine 1 and may have a rectangular shape. An inlet 10*a* may be formed on an upper portion of the cabinet 10 to allow laundry to be entered into the rotating tub 12. The door 40 may be provided on an upper surface of the cabinet 10 to open and close the inlet 10*a*. The inlet 10*a* may be opened and closed by the door 40.

The tub 11 is installed vertically inside the cabinet 10. The tub 11 may accommodate laundry water and may be formed in a shape of a hollow cylinder with a bottom. The tub 11 may be supported on the cabinet 10 by a suspension device 15. Vibrations generated by the tub 11 may be reduced by the suspension device 15.

A water supply pipe 17 is installed at an upper portion of the tub 11 to supply laundry water to the tub 11. One side of the water supply pipe 17 is connected to an external water source, and another side of the water supply pipe 17 is connected to a detergent supply device 16. Water supplied through the water supply pipe 17 is supplied into the tub 11 along with detergent via the detergent supply device 16. A water supply valve 18 is installed in the water supply pipe 17, and the water supply may be adjusted by opening or closing the water supply valve 18. The water supply valve 18 may be electrically connected with a controller 400.

The rotating tub 12 may be formed in a shape of a hollow cylinder with a bottom. The rotating tub 12 may be disposed rotatably inside the tub 11. The rotating tub 12 may have the same rotation axis as that of the tub 11. The rotating tub 12 may be formed in a cylindrical shape with an open top, and a plurality of dehydration holes 13 may be formed on a side surface of the rotating tub 12. A balancer 14 may be mounted on an upper portion of the rotating tub 12 so that the rotating tub 12 may rotate stably during high-speed rotation.

A motor 25 for generating a driving force to rotate the rotating tub 12 and the pulsator 110, and a power switching device 26 for simultaneously or selectively transmitting the driving force generated by the motor 25 to the rotating tub 12 and the pulsator 110 may be installed outside a lower portion of the tub 11. The pulsator 110 may be installed to be rotatable inside the rotating tub 12, and may rotate left or right (forward or backward) to generate a water flow. The laundry accommodated in the rotating tub 12 may be washed by friction due to the water flow.

A hollow dehydration shaft 29 may be coupled to the rotating tub 12, and a washing shaft 27 installed in a hollow portion of the dehydration shaft 29 may be coupled to the pulsator 110. The motor 25 may transfer the driving force to the rotating tub 12 and the pulsator 110 simultaneously or selectively according to a lifting operation of the power switching device 26.

The power switching device 26 may include an actuator 30 that generates a driving force for power switching, a rod portion 31 that linearly moves according to an operation of the actuator 30, and a clutch portion 32 that is connected to the rod portion 31 and rotates according to an operation of the rod portion 31.

The motor 25 may be a direct drive motor capable of changing a rotational speed. In addition, the motor 25 may be implemented as a universal motor composed of a field coil and an armature, a brushless direct current (BLDC) motor composed of a stator and a rotor, a synchronous motor, a direct current (DC) motor, or an induction motor. The motor applicable to the washing machine 1 is not limited thereto.

The motor 25 may stir the pulsator 110 left and right by rotating only the washing shaft 27 in forward or reverse direction while the washing shaft 27 and the dehydration shaft 29 are disengaged. In addition, the motor 25 may simultaneously stir the rotating tub 12 and the pulsator 110 left and right by rotating the washing shaft 27 and the dehydration shaft 29 in the forward or reverse direction while the washing shaft 27 and the dehydration shaft 29 are engaged.

A drain 20 may be formed at the bottom of the tub 11 to drain water stored in the tub 11, and a first drain pipe 21 may be connected to the drain 20. The first drain pipe 21 may be provided with a drain valve 22 which controls drainage. An outlet of the drain valve 22 may be connected to a second drain pipe 23 for discharging water to the outside.

In addition, a water level sensor 60 capable of detecting a water level (amount of water) in the tub 11 may be installed inside a lower side of the tub 11. The water level sensor 60 may detect a frequency that changes according to the water level. The water level sensor 60 may detect the water level in the tub 11 based on a frequency corresponding to an internal pressure of the tub 11.

Figure 3:
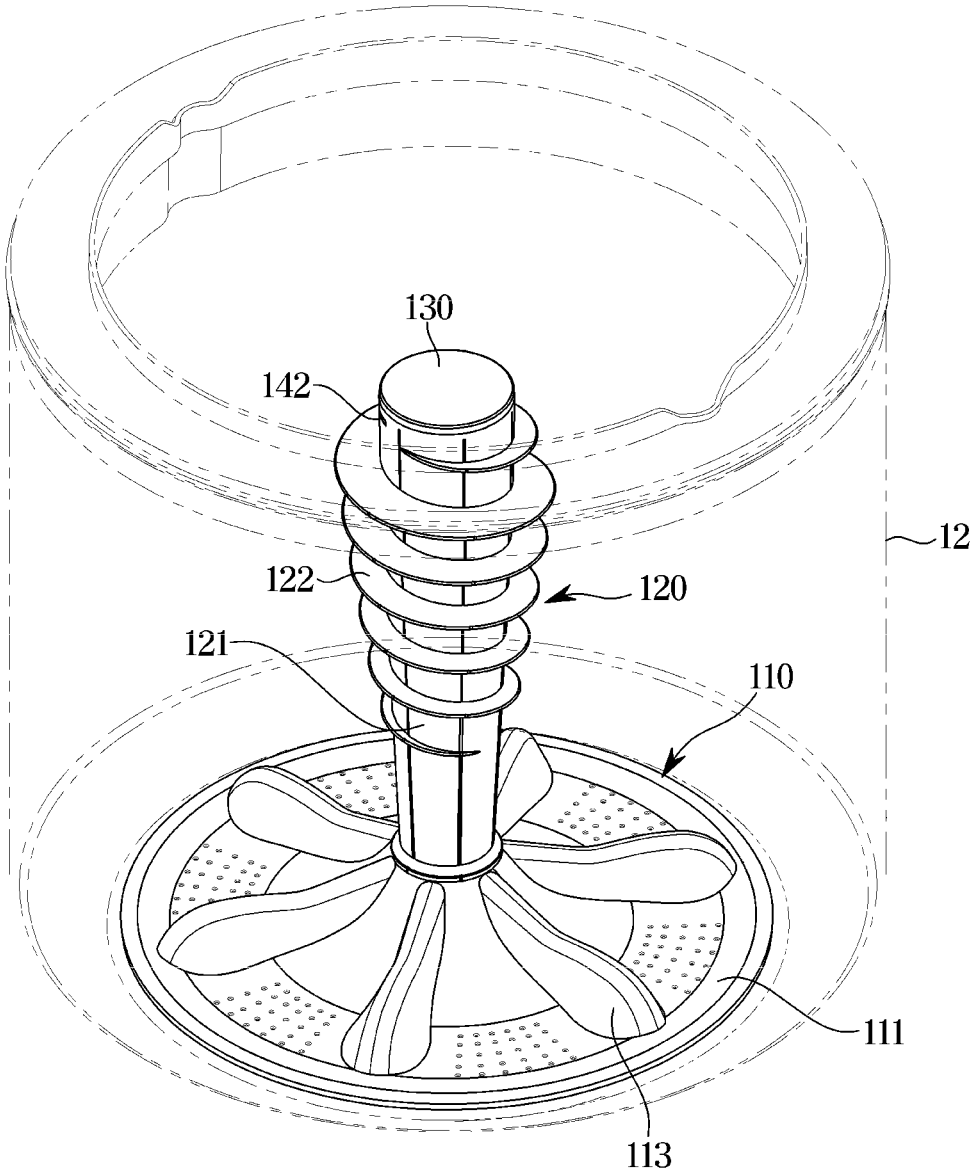
FIG. 3 illustrates a pulsator and a washing rod according to an embodiment of the disclosure.
Figure 4:
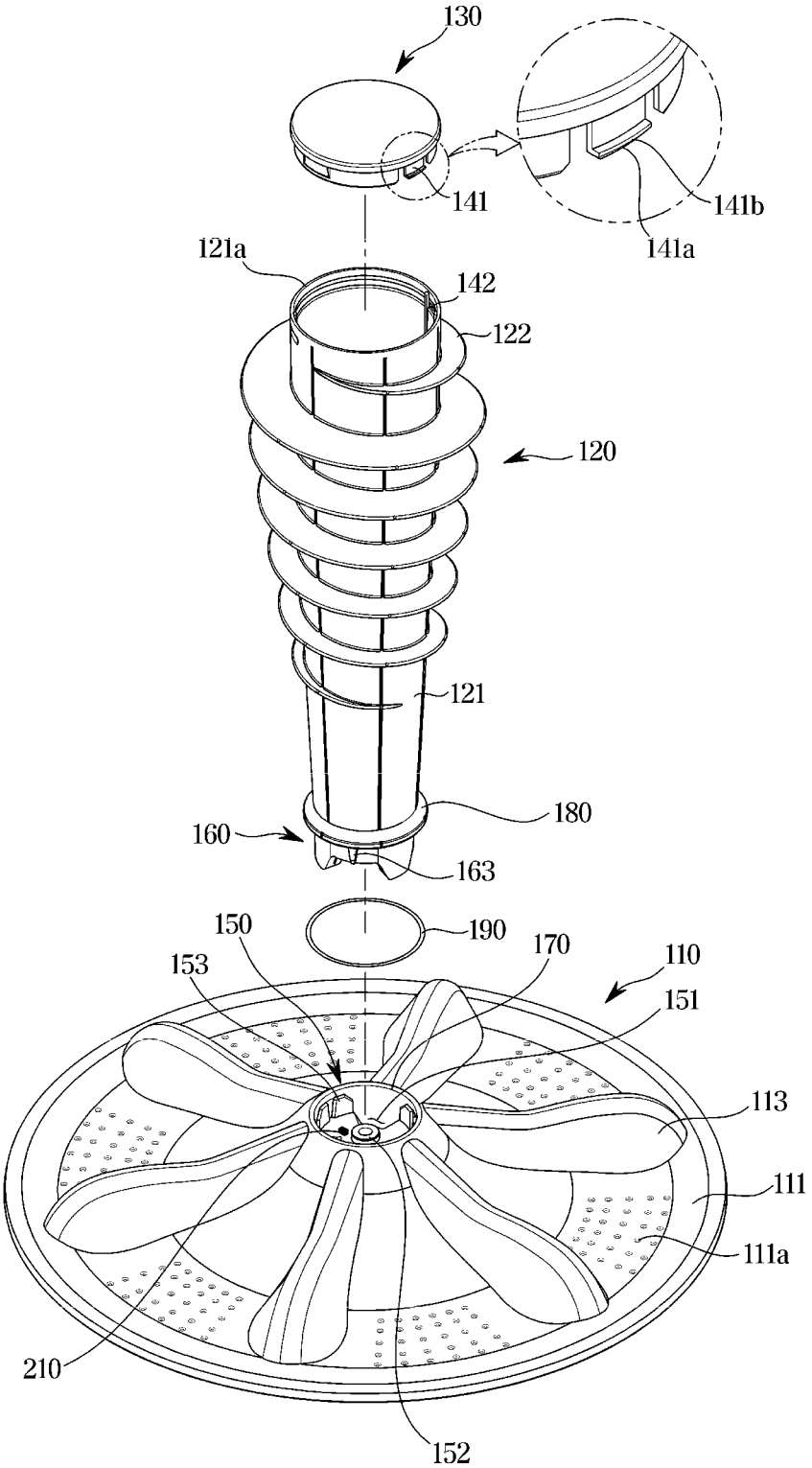
FIG. 4 and FIG. 5 illustrate an coupling structure of a pulsator and a washing rod.
Figure 5:
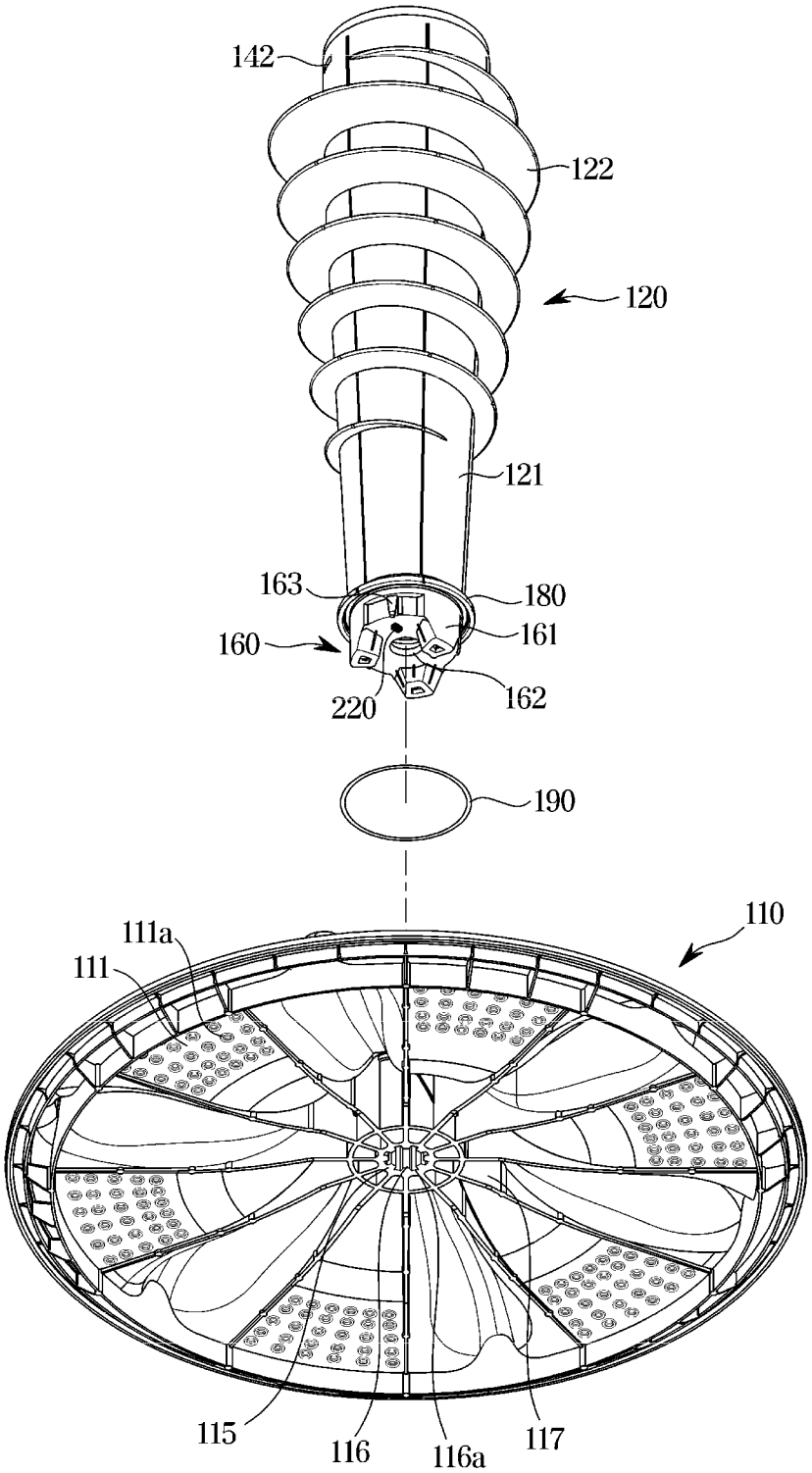

FIG. 3 illustrates a pulsator and a washing rod according to an embodiment of the disclosure. FIG. 4 and FIG. 5 illustrate an coupling structure of a pulsator and a washing rod.

Referring to FIG. 3, FIG. 4, and FIG. 5, the pulsator 110 and the washing rod 120 may be coupled. The washing rod 120 may protrude from a top of the pulsator 110. Forward and backward rotations are repeated in a state where the pulsator 110 and the washing rod 120 are coupled, facilitating generation of water flow more easily.

The pulsator 110 may include a first body 111 and a first blade 113 protruding from a top surface of the first body 111. The first body 111 may be referred to as a 'pulsator body'. The first body 111 of the pulsator 110 may be rotatably mounted on a bottom surface of the rotating tub 12. The first body 111 may be provided in a shape of a disc.

A plurality of first blades 113 may be provided, and may be formed to protrude upwardly from the first body 111. The first blades 113 may be formed to be spaced apart at predetermined intervals along a circumferential direction. The six first blades 113 are illustrated as an example, without being limited thereto. The shape and the number of first blades 113 may be varied. The first blade 113 may also be referred to as a 'pulsator blade'.

A plurality of holes 111*a* may be formed in the first body 111 of the pulsator 110. The plurality of holes 111*a* may be formed to be spaced apart from each of the first blades 113.

The washing rod 120 may be vertically coupled to a center of the pulsator 110. The washing rod 120 may include a second body 121 having a columnar shape, and a second blade 122 protruding from an outer circumferential surface of the second body 121. The second body 121 may be referred to as a 'washing rod body' or 'agitator body'. The second blade 122 may be referred to as a 'washing rod blade' or 'agitator blade'.

The washing rod 120 may be coupled to the pulsator 110 and rotate within the rotating tub 12. Rotation of the washing rod 120 may increase friction between laundry and washing water.

The second blade 122 may protrude around the outer circumferential surface of the second body 121 to improve friction with the laundry. The second blade 122 may be formed in a spiral shape on the outer circumferential surface of the second body 121. The second body 121 and the second blade 122 may be integrally injection molded. The second blade 122 may have a spiral rib shape.

An opening 121*a* is formed at a top of the second body 121 of the washing rod 120. The washing rod 120 may also include a cap 130 provided to cover the opening 121*a*. The cap 130 may be detachably mounted to the opening 121*a* of the second body 121.

The cap 130 may include a hook 141. The cap 130 may be fixed to the second body 121 by the hook 141. The hook 141 may protrude downwardly from the cap 130. The hook 141 may be elastic. The cap 130 may be coupled and fixed to the second body 121 by the elasticity of the hook 141.

A hook hole 142 may be formed on an inner surface of the second body 121 of the washing rod 120. When the hook 141 is positioned in the hook hole 142, the hook 141 and the hook hole 142 may be engaged. A size of the hook hole 142 corresponds to a size of the hook 141, and the number of hook holes 142 are provided to be equal to the number of hooks 141.

Because the hook 141 is elastic, the hook 141 may be easily separated from the hook hole 142. At least one side of the hook 141 engaged with the hook hole 142 may include an inclined surface 141*a* inclined at an angle of 60 degrees. A curved surface 141*b* having a curvature may be formed at an outer end of the inclined surface 141*a*. The inclined surface 141*a* and curved surface 141*b* of the hook 141 are provided to allow the hook 141 to be easily separated from the hook hole 142.

To couple the pulsator 110 and the washing rod 120, the pulsator 110 may be provided with a first coupling portion 150, and the washing rod 120 may be provided with a second coupling portion 160. The first coupling portion 150 may be provided at a center of the pulsator 110. The second coupling portion 160 may be provided at a lower end of the washing rod 120, and may be formed in a shape corresponding to the first coupling portion 150.

The first coupling portion 150 may be formed as a cylindrical recess at a center of the top surface of the first body 111 of the pulsator 110. The second coupling portion 160 may be formed as a protrusion at a lower end of the second body 121 of the washing rod 120. Accordingly, the first coupling portion 150 and the second coupling portion 160 may be coupled.

The first body 111 of the pulsator 110 may be provided with a shaft coupling boss 115 including an anti-shaft rotation groove 116 into which the washing shaft 27 is inserted. The shaft coupling boss 115 may be formed on a center back surface of the first body 111. The shaft coupling boss 115 is formed in a hollow cylindrical shape, and a plurality of spline grooves 116*a* are formed on an inner circumferential surface thereof. A plurality of ribs 117 extending radially around the shaft coupling boss 115 may be formed on the back surface of the first body 111. The plurality of ribs 117 formed on the first body 111 may serve as impellers.

The first coupling portion 150 of the pulsator 110 may include a coupling groove 151 recessed at the center of the top surface of the first body 111. The coupling groove 151 of the first coupling portion 150 may be formed in a cylindrical shape. The second coupling portion 160 of the washing rod 120 may be inserted into the coupling groove 151.

The first coupling portion 150 may include a guide projection 152 formed at the center of the bottom. The guide projection 152 of the first coupling portion 150 may be provided to be connected to the shaft coupling boss 115 formed on the back side of the coupling groove 151. The guide projection 152 may be formed to extend from the shaft coupling boss 115.

The second coupling portion 160 of the washing rod 120 may include a coupling projection 161. The coupling projection 161 may be formed on a lower portion of the washing rod 120 so that the coupling projection 161 is inserted into the coupling groove 151 of the pulsator 110. The coupling projection 161 of the second coupling portion 160 may have a shape and size that corresponds to the coupling groove 151 of the first coupling portion 150. The coupling projection 161 may be integrally formed with the second body 121 of the second coupling portion 160. The second coupling portion 160 may be extended and protrude from the lower portion of the second body 121.

The guide projection 152 of the first coupling portion 150 may be provided to correspond to a guide hole 162 of the second coupling portion 160. The guide projection 152 of the first coupling portion 150 may be inserted into the guide hole 162 of the second coupling portion 160. A size of the guide projection 152 corresponds to a size of the guide hole 162, and a shape of the guide projection 152 corresponds to a shape of the guide hole 162. The guide projection 152 and the guide hole 162 may guide coupling of the first coupling portion 150 and the second coupling portion 160.

In addition, a reinforcing rib 163 may be formed on the second coupling portion 160 of the washing rod 120 to reinforce a strength of the coupling of the first coupling portion 150 and the second coupling portion 160. The reinforcing rib 163 may be provided on a side of the coupling projection 161 of the second coupling portion 160. For example, the reinforcing rib 163 may protrude in a vertical direction on an outer circumferential surface of the coupling projection 161. The reinforcing rib 163 may be formed in a shape of an inverted triangle or an inverted trapezoid. The reinforcing rib 163 may have an upper side longer than a lower side.

A reinforcing rib groove 153 corresponding to the reinforcing rib 163 may be formed in the first coupling portion 150. The reinforcing rib groove 153 may be formed in the coupling groove 151 of the first coupling portion 150. The reinforcing rib groove 153 may be formed on an inner circumferential surface of the coupling groove 151. The reinforcing rib groove 153 may be formed so that the reinforcing rib 163 is inserted and coupled.

The first coupling portion 150 of the pulsator 110 may be provided with a first support portion 170, and the second coupling portion 160 of the washing rod 120 may be provided with a second support portion 180. The first support portion 170 is provided on an upper circumference of the coupling groove 151 of the first coupling portion 150. The second support portion 180 may protrude along the outer circumferential surface of the second body 121 of the washing rod 120. The second support portion 180 may be formed on a top of the coupling projection 161. The first support portion 170 may be coupled to the second support portion 180.

A sealing member 190 may be provided between the pulsator 110 and the washing rod 120. The sealing member 190 may be provided between the first coupling portion 150 and the second coupling portion 160. The sealing member 190 may be inserted into the second support portion 180 of the second coupling portion 160.

The sealing member 190 may absorb impacts between the pulsator 110 and the washing rod 120. The sealing member 190 may reduce the impact at an area where the first coupling portion 150 and the second coupling portion 160 contact. Furthermore, the sealing member 190 may fill a gap between the first coupling portion 150 and the second coupling portion 160.

Also, the first coupling portion 150 of the pulsator 110 may be provided with a washing rod sensor 210. The washing rod sensor 210 may be positioned within the coupling groove 151. The second coupling portion 160 of the washing rod 120 may be provided with an identifier 220 detected by the washing rod sensor 210. The identifier 220 may be located at a lower surface of the second coupling portion 160. The identifier 220 may be disposed to correspond to a position of the washing rod sensor 210. A coupled state or a decoupled state of the pulsator 110 and the washing rod 120 may be identified depending on whether the washing rod sensor 210 detects the identifier 220.

The washing rod sensor 210 and the identifier 220 may be provided in various types. For example, the identifier 220 may be a magnet, and the washing rod sensor 210 may include a magnet sensor detecting a magnetic force generated by the magnet. In response to detecting a magnetic force of the identifier 220, the washing rod sensor 210 may transmit a detection signal to the controller 400.

As another example, the washing rod sensor 210 may include a light sensor that detects the identifier 220 by emitting light and receiving light reflected from the identifier 220. As still another example, the washing rod sensor 210 may include a short-range communication module. The washing rod sensor 210 may be provided as a near field communication (NFC) reader, and the identifier 220 may be provided as an NFC tag. In response to the pulsator 110 and the washing rod 120 being coupled, the washing rod sensor 210 may detect the NFC tag, and transmit a detection signal to the controller 400 based on the detection of the NFC tag.

The washing rod sensor 210 is not limited to the examples above. Any type of sensor capable of detecting the coupling of the pulsator 110 and the washing rod 120 may be employed.

Figure 6:
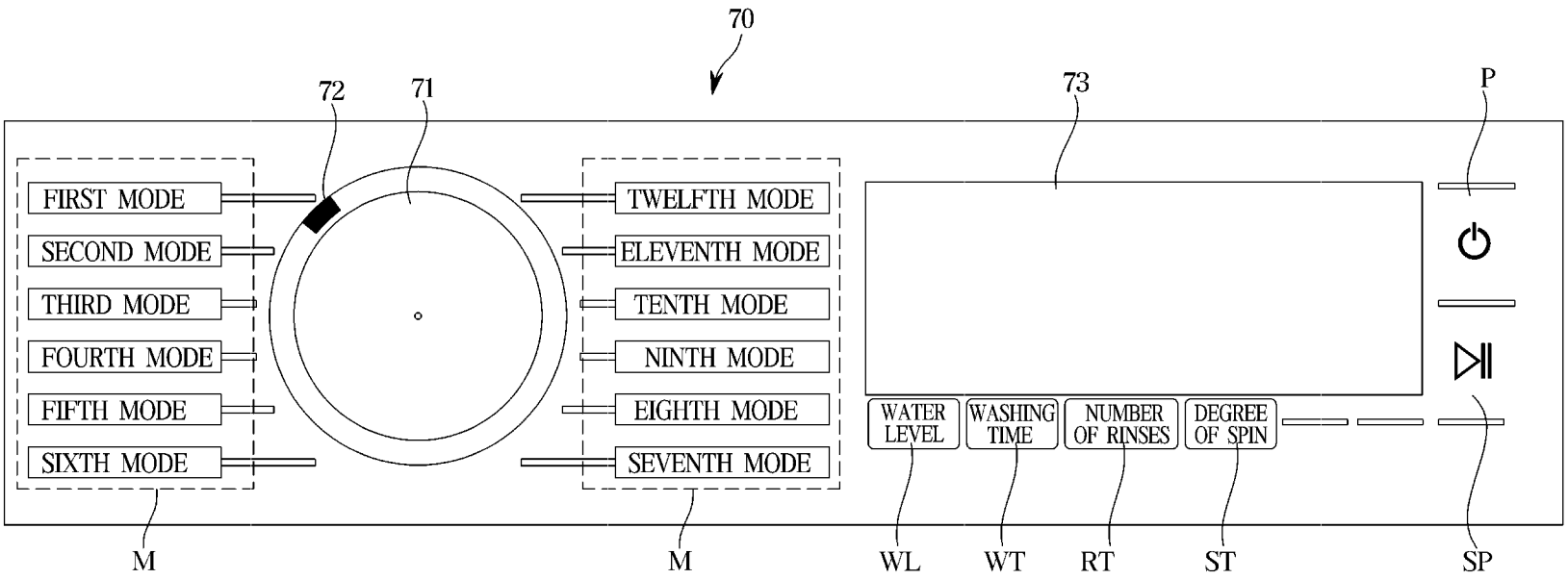
FIG. 6 illustrates a control panel of a washing machine according to an embodiment of the disclosure.

FIG. 6 illustrates a control panel of a washing machine according to an embodiment of the disclosure.

Referring to FIG. 6, the control panel 70 may obtain various user inputs for operating the washing machine 1. The control panel 70 may also display information related to operations of the washing machine 1. For example, the control panel 70 may include the dial 71 and the display 73. The control panel 70 may also include a plurality of buttons and/or a touch screen.

For example, the control panel 70 may include a power button P for turning on/off of the washing machine 1. The washing machine 1 may be turned on or off based on pushing or touching the power button P by a user. When a power-on command is input by pushing or touching the power button P, the control panel 70 may display various selectable user interface UI elements.

The control panel 70 may also include a variety of buttons, such as a start/stop button SP for starting or stopping operations of the washing machine 1, a water level button WL for selecting a water level, a washing time button WT for selecting a washing time, a rinsing number button RT for selecting the number of rinses, a dehydration time button ST for selecting a dehydration time, a water temperature button (not shown) for selecting a water temperature, and the like. The above-described buttons may be provided as physical buttons or touch buttons.

The control panel 70 may include the rotatable dial 71 for selecting a washing mode and an indicator 72 for indicating the selected washing mode. The indicator 72 may be implemented as a light emitting diode (LED). The dial 71 may be provided in a circular shape, and a plurality of LEDs may be disposed along a circumference of the dial 71.

A user may select one of the plurality of washing modes M by turning the dial 71. The indicator 72 may be illuminated according to rotation of the dial 71. Furthermore, a position of the illuminated indicator 72 may change with the rotation of the dial 71. As the dial 71 is rotated clockwise, a position of the indicator 72 may change to indicate one of the plurality of washing modes M.

Selection of one of the plurality of washing modes M may be made sequentially as the dial 71 is rotated. For example, by rotating the dial 71 clockwise, a first mode, a second mode, a third mode, a fourth mode, a fifth mode, a sixth mode, a seventh mode, an eighth mode, a ninth mode, a tenth mode, an eleventh mode, and a twelfth mode may be selected in sequence.

The plurality of washing modes M exemplified by the first to twelfth modes may include a standard mode, a powerful mode, a quick mode, a delicate mode, a soak mode, a colored clothes mode, a bedding mode, a large volume mode, a rinsing mode, a dehydration mode, a water saving mode, and a tub cleaning mode. The washing modes are not limited thereto, and various washing modes may be provided by design.

The control panel 70 may include a LED for displaying the plurality of washing modes M. Light may be emitted from the LED for displaying each of the plurality of washing modes M. In other words, the controller 400 may control the control panel 70 to cause each of the plurality of washing modes M to be illuminated. For example, the controller 400 may control the control panel 70 to display at least one washing mode corresponding to a coupled state of the washing rod 120 or a decoupled state of the washing rod 120 from among the plurality of washing modes M.

As another example, the dial 71 may be replaced by a button, and each time the user presses the button, the selection of the washing modes M may change. As still another example, each of the plurality of washing modes M may be provided as a button, and each of the plurality of washing modes M may be selected by each button.

The display 73 may display various information related to operations of the washing machine 1. The display 73 may display information input by the user or information provided to the user as various screens. The display 73 may also display a graphical user interface (GUI) enabling control of the washing machine 1.

For example, the display 73 may display information about detailed options of the washing modes (e.g., water level, washing time, the number of rinses, degree of spin). The display 73 may also display at least one washing mode corresponding to a coupled state of the washing rod 120 or a decoupled state of the washing rod 120 from among the plurality of washing modes M.

The control panel 70 is not limited thereto and may be of various designs.

Figure 7:
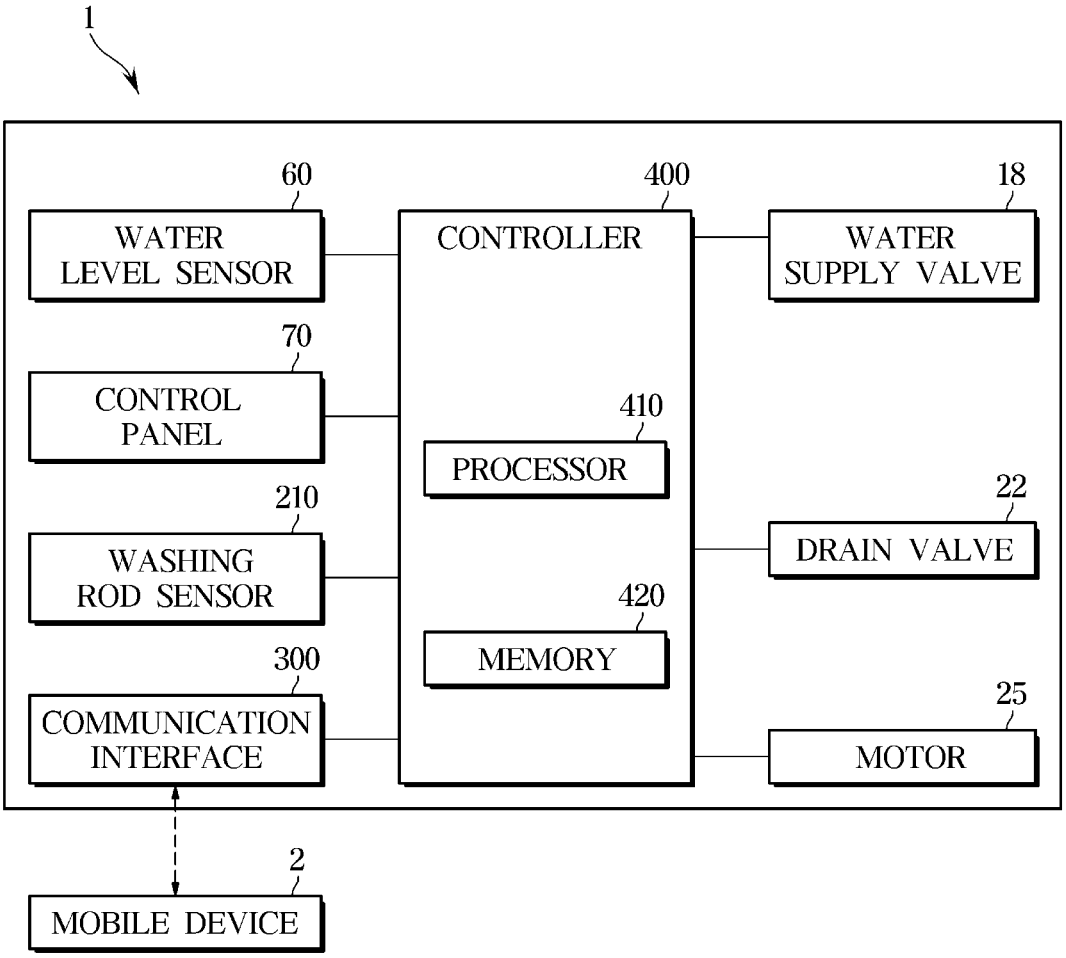
FIG. 7 is a block diagram illustrating constituent components of a washing machine according to an embodiment of the disclosure.

FIG. 7 is a block diagram illustrating constituent components of a washing machine according to an embodiment of the disclosure.

Referring to FIG. 7, the washing machine 1 may include the water supply valve 18, the drain valve 22, the motor 25, the water level sensor 60, the control panel 70, the washing rod sensor 210, a communication interface 300, and the controller 400. The controller 400 may be electrically connected to components of the washing machine 1 and may control operations of the components of the washing machine 1.

The water supply valve 18 may open or close the water supply pipe 17 supplying water to the tub 11. That is, the water supply may be controlled by opening or closing the water supply valve 18. The controller 400 may control the opening or closing of the water supply valve 18. The controller 400 may open the water supply valve 18 in response to starting a washing operation or a rinsing operation.

The drain valve 22 may open or close the drain pipes 21 and 23 for draining water in the tub 11 to the outside. The controller 400 may control the opening or closing of the drain valve 22. The controller 400 may open the drain valve 22, in response to the washing operation or the rinsing operation being completed.

The motor 25 may rotate the rotating tub 12 and the pulsator 110 under the control of the controller 400. The rotating tub 12 and the pulsator 110 may rotate alternately in forward and reverse directions by an operation of the motor 25. The controller 400 may control a rotational speed of the motor 25 by adjusting a magnitude of a current applied to the motor 25. The controller 400 may change a direction of rotation of the motor 25.

The water level sensor 60 may detect a water level in the tub 11. The water level sensor 60 may detect a frequency that varies with the water level. The water level sensor 60 may detect the water level in the tub 11 based on a frequency corresponding to an internal pressure of the tub 11. For example, as the water level increases, the pressure in the tub 11 increases and the frequency decreases. In contrast, as the water level decreases, the pressure in the tub 11 decreases and the frequency increases. The water level sensor 60 may transmit an electrical signal corresponding to the water level in the tub 11 to the controller 400.

The control panel 70 may include the rotatable dial 71 and buttons for obtaining a user input, and the display 73 displaying information related to operations of the washing machine 1. The control panel 70 may provide a user interface for interaction between the user and the washing machine 1. The control panel 70 may be provided in various forms at various locations on the washing machine 1 depending on design.

The controller 400 may obtain a washing mode selection input through the dial 71. The controller 400 may control the display 73 to display detailed options of the selected washing mode (e.g., water level, washing time, the number of rinses, degree of spin). The controller 400 may obtain an execution command for the selected washing mode via the start/stop button SP, and may perform an operation corresponding to the selected washing mode.

The detailed options of the washing mode may be set differently for each of the plurality of washing modes M. For example, for a washing mode requiring the use of the washing rod 120, the amount of laundry may be set to be relatively small, a water level may be set to be relatively high, a washing time may be set to be relatively short, and an operating rate of the motor 25 may be set to be relatively low. The operating rate of the motor 25 may refer to a rotational speed of the motor 25 and/or the number of direction change of the motor 25.

When the amount of laundry is small, less friction may occur between the laundry, resulting in a reduction in washing efficiency. The washing rod 120 may be used to increase a frictional force applied to the small amount of laundry. The use of the washing rod 120 is suitable for washing the relatively small amount of laundry, because a load space of the rotating tub 12 is reduced when the washing rod 120 is installed.

A high water level may be required considering a length of the washing rod 120. The motor 25 may be set at a low operating rate to reduce damage to the laundry due to friction between the washing rod 120 and the laundry. Because the use of the washing rod 120 improves washing efficiency, a shorter washing time may be set.

In contrast, for a washing mode that does not require a use of the washing rod 120, a water level may be set relatively low, a washing time may be set relatively long, and an operating rate of the motor 25 may be set relatively high.

The controller 400 may control the control panel 70 to display at least one washing mode corresponding to a coupled state of the washing rod 120 or a decoupled state of the washing rod 120 from among the plurality of washing modes M. Further, the controller 400 may control the control panel 70 to display guide information that recommends coupling or decoupling of the washing rod 120 through the display 73.

The display 73 may include various types of display panels. For example, the display 73 may include a liquid crystal display (LCD) panel, a light emitting diode (LED) panel, an organic LED (OLED) panel, or a micro LED panel. The display 73 may be used as an input device by including a touch screen.

The washing rod sensor 210 may detect coupling or decoupling of the pulsator 110 and the washing rod 120. The washing rod sensor 210 may transmit a detection signal corresponding to the coupling or decoupling of the washing rod 120 to the controller 400. The controller 400 may identify coupling or decoupling of the pulsator 110 and the washing rod 120 based on the signal transmitted from the washing rod sensor 210.

Based on the pulsator 110 and the washing rod 120 being coupled, the washing rod sensor 210 and the identifier 220 may be in contact with each other or face each other at adjacent locations. Accordingly, the washing rod sensor 210 may detect the identifier 220. The washing rod sensor 210 may transmit a detection signal corresponding to the coupling of the pulsator 110 and the washing rod 120 to the controller 400. Based on the pulsator 110 and the washing rod 120 being decoupled, the washing rod sensor 210 may transmit an electrical signal corresponding to the decoupling of the pulsator 110 and the washing rod 120 to the controller 400.

The communication interface 300 may perform communication with an external device. For example, the communication interface 300 may support establishing a communication channel or wireless communication channel between an external mobile device 2 or an external server (not shown), and may support communication over the established communication channel. The communication interface 300 may be implemented with a variety of communication technologies. For example, the communication interface 300 may include a wireless communication module and/or a wired communication module. The wireless communication module may support wireless local area network (WLAN), home radio frequency (RF), infrared communication, ultra-wide band (UWB) communication, Wi-Fi, Wi-Fi Direct, Bluetooth, AD-HOC, and/or Zigbee.

The external mobile device 2 may obtain a user input, and transmit a control signal corresponding to the user input to the washing machine 1. The washing machine 1 may receive the control signal transmitted from the external mobile device 2, and perform an operation corresponding to the control signal. The external mobile device 2 may include an application for controlling the washing machine 1. The external mobile device 2 may display a graphical user interface (GUI) enabling control of the washing machine 1. A user may use the external mobile device 2 to operate the washing machine 1. The external mobile device 2 may transmit a control signal to the washing machine 1 based on a user input obtained after executing the application.

The controller 400 may include a processor 410 for generating a control signal for controlling operations of the washing machine 1 and a memory 420 storing programs, applications, instructions and data for controlling the operations of the washing machine 1. The processor 410 and the memory 420 may be implemented in separate semiconductor devices or in a single semiconductor device. In addition, the controller 400 may include a plurality of processors and a plurality of memories. The controller 400 may be provided at various locations inside the washing machine 1. For example, the controller 400 may be included in a printed circuit board provided inside the control panel 70.

The processor 410 may include an arithmetic circuit, a memory circuit and a control circuit. The processor 410 may include a single chip or a plurality of chips. Also, the processor 410 may include a single core or a plurality of cores.

The processor 410 may process data and/or signals using the programs provided from the memory 420, and transmit a control signal to each component of the washing machine 1 based on a result of the processing. For example, the processor 410 may obtain a user input through the control panel 70 or the communication interface 300. The processor 410 may output control signals for controlling the motor 25, the water supply valve 18, and the drain valve 22 to perform an operation according to a washing mode.

The memory 420 may store a program for performing an operation according to a washing mode of the washing machine 1, and data including settings for the operation according to the washing mode. The memory 420 may include a volatile memory, such as Static Random Access Memory (SRAM) or Dynamic Random Access Memory (DRAM), and a non-volatile memory, such as Read Only Memory (ROM) or Erasable Programmable Read Only Memory (EPROM). The memory 420 may include a single memory device or may include a plurality of memory devices.

As described above, the controller 400 may identify whether the pulsator 110 and the washing rod 120 are coupled based on a detection signal of the washing rod sensor 210. The controller 400 may control the control panel 70 to display at least one washing mode corresponding to the coupled state of the washing rod 120 or the decoupled state of the washing rod 120 from among the plurality of washing modes M. The controller 400 may also control the communication interface 300 to transmit display information about the at least one washing mode to the external mobile device 2.

For example, the controller 400 may control the control panel 70 to identifiably display at least one first washing mode that requires a use of the washing rod 120, based on the coupled state of the washing rod 120. The controller 400 may control the control panel 70 to identifiably display other washing modes other than the at least one first washing mode that requires use of the washing rod 120, based on the decoupled state of the washing rod 120.

Also, in the coupled state of the washing rod 120, the controller 400 may control the control panel 70 to display first guide information that recommends decoupling of the washing rod 120, based on a second washing mode that does not require the use of the washing rod 120 being selected by a user input. In the decoupled state of the washing rod 120, the controller 400 may control the control panel 70 to display second guide information that recommends coupling of the washing rod 120, based on one of the at least one first washing mode requiring the use of the washing rod 120 being selected by a user input.

Meanwhile, the controller 400 may receive an execution command of a washing mode executable in both the coupled state of the washing rod 120 and the decoupled state of the washing rod 120 through the control panel 70 or the external mobile device 2. The at least one washing mode corresponding to the coupled state of the washing rod 120 or the decoupled state of the washing rod 120 may include the washing mode executable in both the coupled state of the washing rod 120 and the decoupled state of the washing rod 120.

For example, a standard mode and a rinsing mode may be executed in the coupled state of the washing rod 120 or the decoupled state of the washing rod 120. The washing mode executable in both the coupled state of the washing rod 120 and the decoupled state of the washing rod 120 may be set during design. A soak mode, a dehydration mode, and a tub cleaning mode may be executed regardless of whether the washing rod 120 is coupled.

The controller 400 may detect a weight of the laundry and/or the amount of laundry accommodated in the rotating tub 12, based on an input of the execution command of the washing mode executable in both the coupled state of the washing rod 120 and the decoupled state of the washing rod 120. Various known methods may be used to detect the weight and/or amount of laundry.

The weight of the laundry may be divided into different levels. For example, when a maximum capacity of the washing machine 1 is 10 kg, the weight of the laundry may be divided into four levels. A first level may be defined as a light load, ranging from 0 kg to 2.5 kg. A second level may be defined as a medium load, ranging from 2.6 kg to 5 kg. A third level may be defined as a large load, ranging from 5.1 kg to 7.5 kg. A fourth level may be defined as a maximum load, ranging from 7.6 kg to 10 kg.

The controller 400 may control the control panel 70 to display the first guide information that recommends decoupling of the washing rod 120 or the second guide information that recommends coupling of the washing rod 120, based on the weight of the laundry.

For example, the controller 400 may control the control panel 70 to display the first guide information that recommends decoupling of the washing rod 120, based on the weight of the laundry detected in the coupled state of the washing rod 120 exceeding a predetermined reference level. The reference level may refer to the first level representing the light load. The reference level may change depending on the design. The weight of the laundry exceeding the predetermined reference level indicates that the amount of laundry is relatively large. In response to a large amount of laundry being accommodated, a larger interior space of the rotating tub 12 may be ensured by removing the washing rod 120.

Also, the controller 400 may control the control panel 70 to display the second guide information that recommends coupling of the washing rod 120, based on the weight of the laundry detected in the decoupled state of the washing rod 120 being equal to or less than the predetermined reference level. The weight of the laundry being equal to or less than the predetermined reference level indicates that the amount of laundry is relatively small. In response to a small amount of laundry being accommodated, a washing efficiency may be improved by using the washing rod 120.

A user may also be provided with guide information that recommends decoupling or coupling of the washing rod 120 through the external mobile device 2. After the guide information is provided, the user may input a confirmation command for decoupling or coupling the washing rod 120 through the control panel 70 or the external mobile device 2. The controller 400 of the washing machine 1 may determine to decouple or couple the washing rod 120 based on the input confirmation command.

Based on the determination on the decoupling or coupling of the washing rod 120 based on the weight of the laundry, the controller 400 may control the motor 25 so that the rotating tub 12 rotates to move the laundry to a side wall of the rotating tub 12. When the laundry moves to the side wall of the rotating tub 12 by rotating the rotating tub 12 at a predetermined speed, a central space in the rotating tub 12 may be secured, and thus the user may couple or decouple the washing rod 120 more easily.

After the guide information is provided, the user may also input a cancellation command for decoupling or coupling the washing rod 120. Based on an input of a cancellation command for decoupling or coupling the washing rod 120, the controller 400 may operate the washing machine 1 according to a washing mode selected in a current state, regardless of whether the washing rod 120 is coupled.

Meanwhile, the control panel 70 or the external mobile device 2 may provide a setting option for whether to provide guide information about decoupling or coupling of the washing rod 120. The user may select whether to receive the guide information. The user may operate the control panel 70 or the external mobile device 2 to activate or deactivate a provision function of the guide information about decoupling or coupling of the washing rod 120. In response to the provision function of the guide information being deactivated, no guide information is provided via the control panel 70 or the external mobile device 2.

Hereinafter, described are various embodiments of the control panel 70 changing according to a user input and whether the pulsator 110 and the washing rod 120 are coupled.

Figure 8:
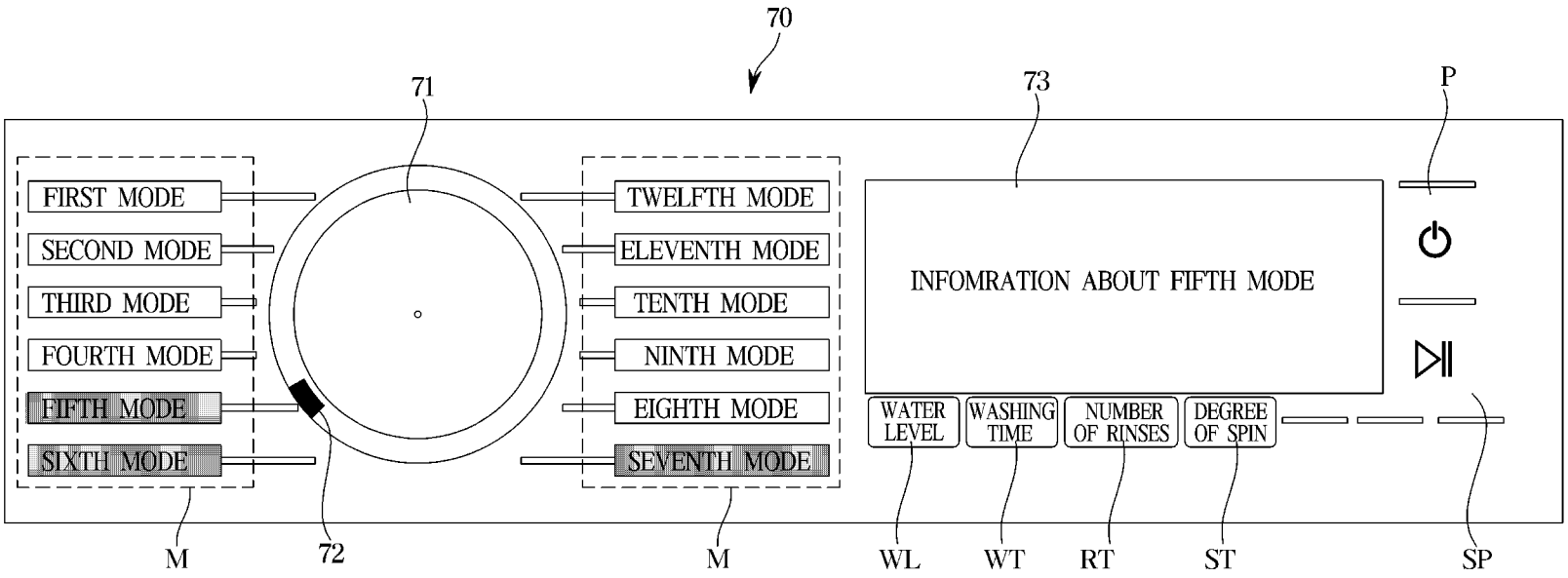
FIG. 8 illustrates a first embodiment of a control panel that changes according to a user input and whether a pulsator is coupled to a washing rod.

FIG. 8 illustrates a first embodiment of a control panel that changes according to a user input and whether a pulsator is coupled to a washing rod.

Referring to FIG. 8, once the washing machine 1 is turned on, the controller 400 may identify a coupled state or a decoupled state of the pulsator 110 and the washing rod 120 based on a detection signal transmitted from the washing rod sensor 210.

In response to the pulsator 110 and the washing rod 120 being coupled, the controller 400 of the washing machine 1 may control the control panel 70 to identifiably display at least one first washing mode that requires a use of the washing rod 120. For example, the fifth mode, the sixth mode, and the seventh mode among the plurality of washing modes M may be included in the first washing mode set to require the use of the washing rod 120. The controller 400 of the washing machine 1 may control the control panel 70 so that the fifth mode, the sixth mode, and the seventh mode are illuminated. Accordingly, the fifth mode, the sixth mode, and the seventh mode may be highlighted.

The fifth mode, the sixth mode, and the seventh mode may represent a powerful mode, a quick mode, and a colored clothes mode, respectively. The powerful mode may be set to require the use of the washing rod 120 in order to wash the laundry strongly. The quick mode may be set to require the use of the washing rod 120 in order to wash the laundry quickly. The colored clothes mode may be set to require the use of the washing rod 120 in order to effectively wash a small amount of colored clothes.

In a state where the pulsator 110 and the washing rod 120 are coupled and the fifth mode, the sixth mode, and the seventh mode are highlighted, a user may select the fifth mode by turning the dial 71. The indicator 72, which moves with the rotation of the dial 71, may illuminate at a position corresponding to the fifth mode. Accordingly, the user may recognize that the fifth mode has been selected.

Because the fifth mode suitable for the coupled state of the washing rod 120 has been selected, the display 73 of the control panel 70 may display information about the fifth mode (e.g., water level, washing time, the number of rinses, degree of spin).

In addition to the fifth mode, the sixth mode, and the seventh mode highlighted in response to the coupled state of the washing rod 120, the control panel 70 may be controlled to allow the user to select other washing modes. For example, the user may select the third mode by operating the dial 71 while the fifth, sixth, and seventh modes are highlighted.

In other words, even though the fifth mode, the sixth mode, and the seventh mode are highlighted, the user may select any other washing mode desired, i.e., the user's selection may not be limited to one of the highlighted fifth, sixth, and seventh modes.

In another embodiment, the control panel 70 may be controlled so that only the fifth mode, the sixth mode, and the seventh mode corresponding to the coupled state of the washing rod 120 are selectable, i.e., the fifth, sixth, and seventh modes are activated and the other washing modes are deactivated. The deactivated washing modes may be temporarily set to be unselectable. The user may also activate all the washing modes by pressing a separate button (e.g., a start/stop button).

Figure 9:
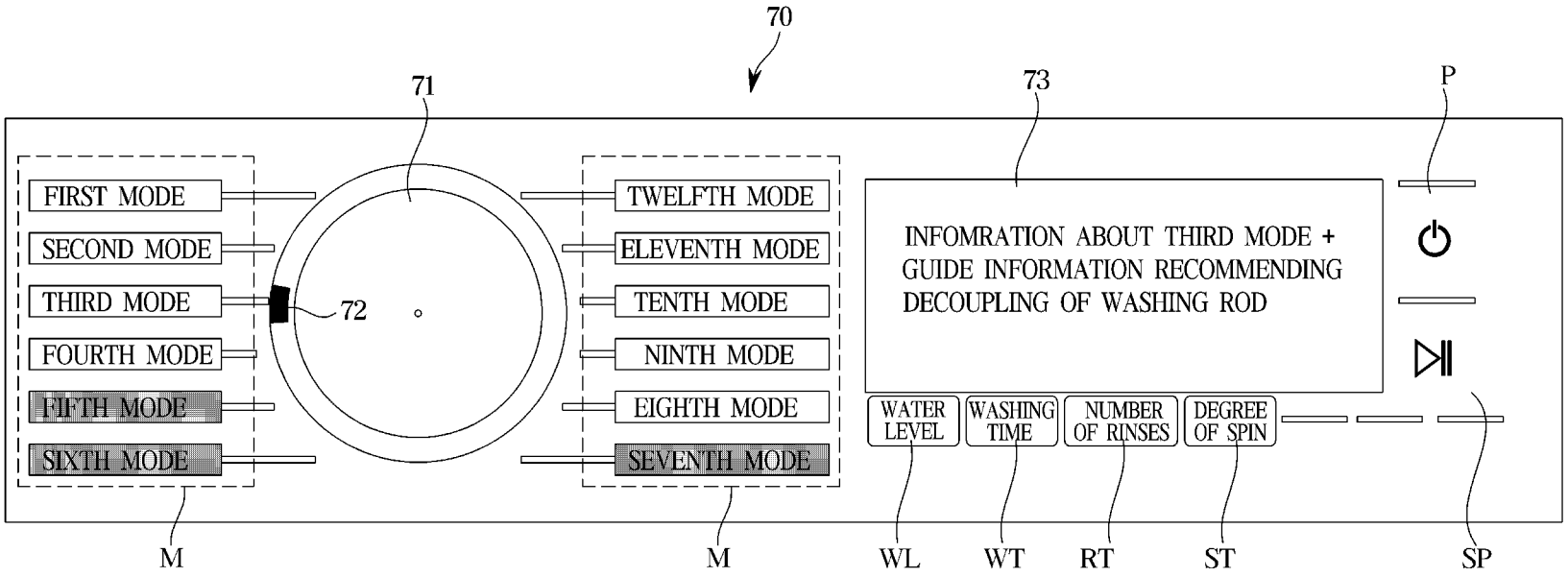
FIG. 9 illustrates a second embodiment of a control panel that changes according to a user input and whether a pulsator is coupled to a washing rod.

FIG. 9 illustrates a second embodiment of a control panel that changes according to a user input and whether a pulsator is coupled to a washing rod.

Referring to FIG. 9, in a state where the pulsator 110 and the washing rod 120 are coupled, a second washing mode that does not require a use of the washing rod 120 may be selected by a user input. For example, the second mode, the third mode, and the fourth mode from among the plurality of washing modes M may be included in the second washing mode set to require non-use of the washing rod 120.

The second mode, the third mode, and the fourth mode may represent a delicate mode, a large volume mode, and a water saving mode, respectively. The delicate mode may be set to require non-use of the washing rod 120 in order to minimize damage to delicate clothes such as underwear. The large volume mode of the washing machine may be set to require non-use of the washing rod 120 because a large amount of load space is required. The large volume mode may include a bedding mode and a blanket mode. The water saving mode may be set to require non-use of the washing rod 120 in order to use minimal water.

In a state where the fifth mode, the sixth mode, and the seventh mode are highlighted in response to the coupled state of the pulsator 110 and the washing rod 120, a user may turn the dial 71 to select the third mode. The indicator 72, which moves with the rotation of the dial 71, may illuminate at a position corresponding to the third mode. Accordingly, the user may recognize that the third mode has been selected. Information about the selected third mode may be displayed on the control panel 70.

In a current state where the pulsator 110 and the washing rod 120 are coupled, applying the third mode that does not require a use of the washing rod 120 is not suitable. Accordingly, preferably, decoupling of the washing rod 120 is guided to the user. That is, in response to the second washing mode that does not require a use of the washing rod 120 being selected in a coupled state of the washing rod 120, the controller 400 may control the control panel 70 to display first guide information that recommends decoupling of the washing rod 120.

The user may input a confirmation command for decoupling the washing rod 120 through the control panel 70 or the external mobile device 2. Based on an input of the confirmation command for decoupling the washing rod 120, the washing machine 1 may be in a standby state until the washing rod 120 is decoupled from the pulsator 110.

Unlike the second mode through the seventh mode described above, the first mode, and the eighth mode through the twelfth mode may be set to be executable in both the coupled state of the washing rod 120 and the decoupled state of the washing rod 120. For example, the first mode, and the eighth mode through the twelfth mode may include a standard mode, a rinsing mode, a soak mode, a dehydration mode, and a tub cleaning mode. Whether the washing rod 120 is used in the first mode, and the eighth mode through the twelfth mode may depend on a weight of the laundry.

When a user selects one of the first mode, and the eighth mode through the twelfth mode and inputs an execution command, first guide information that recommends decoupling of the washing rod 120 or second guide information that recommends coupling of the washing rod 120 may be provided depending on the weight of the laundry. The user may input a confirmation command or a cancellation command for decoupling or coupling of the washing rod 120. The controller 400 may control the motor 25 to rotate the rotating tub 12 based on the confirmation command. Based on the cancellation command, the controller 400 may operate the washing machine 1 according to a washing mode selected in a current state, regardless of whether the washing rod 120 is coupled.

The washing modes requiring the use or non-use of the washing rod 120 are not limited to those described above. The washing modes may be varied by design. For example, contrary to the foregoing, the second mode, the third mode, and the fourth mode may be set to require a use of the washing rod 120, and the fifth mode, the sixth mode, and the seventh mode may be set to require non-use of the washing rod 120.

Figure 10:
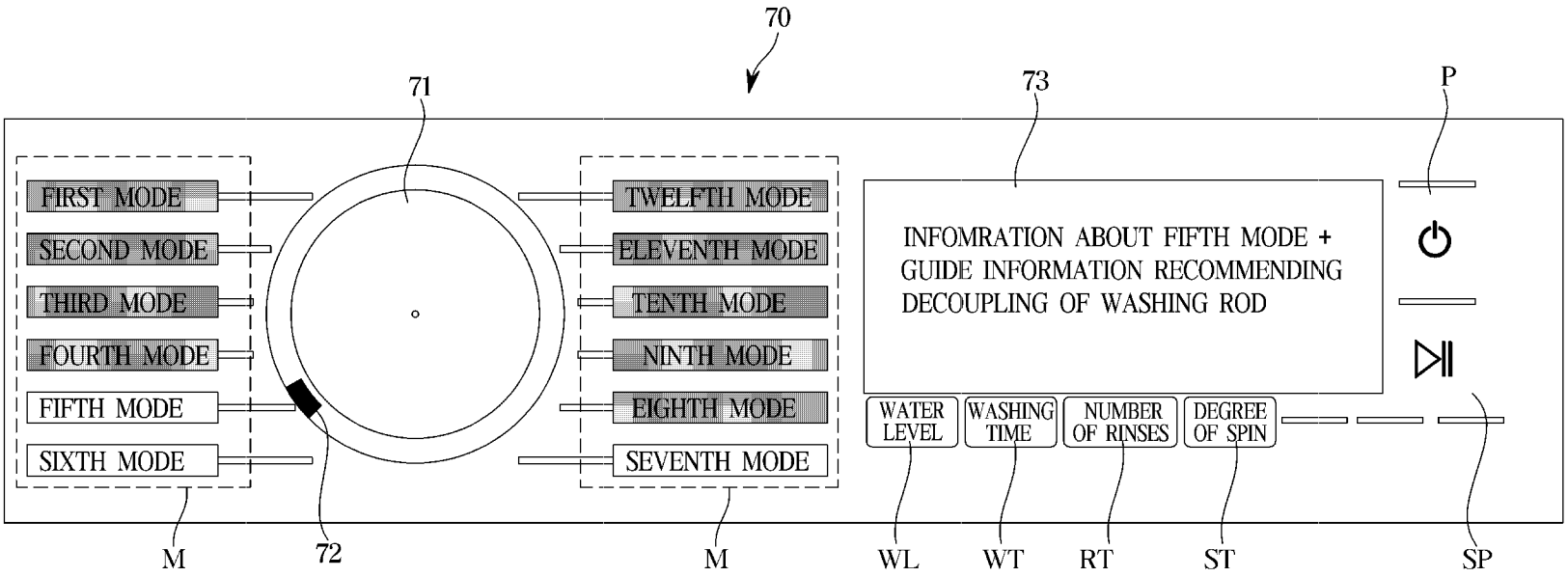
FIG. 10 illustrates a third embodiment of a control panel that changes according to a user input and whether a pulsator is coupled to a washing rod.

FIG. 10 illustrates a third embodiment of a control panel that changes according to a user input and whether a pulsator is coupled to a washing rod.

Referring to FIG. 10, in a state where the pulsator 110 and the washing rod 120 are decoupled, the control panel 70 may identifiably display other washing modes other than at least one washing mode requiring a use of the washing rod 120. For example, the other washing modes except for the fifth mode, the sixth mode, and the seventh mode that are set to require the use of the washing rod 120 may be highlighted.

In a state where the pulsator 110 and the washing rod 120 are decoupled, one of the at least one washing mode that requires use of the washing rod 120 may be selected by user input. For example, the fifth mode may be selected by rotation of the dial 71. In this case, the controller 400 may control the control panel 70 to display second guide information that recommends coupling of the washing rod 120. Information about the selected fifth mode may also be displayed on the control panel 70.

In a current state where the pulsator 110 and the washing rod 120 are decoupled, applying a washing mode that requires the use of the washing rod 120 is not suitable. Accordingly, preferably, coupling of the washing rod 120 is guided to the user.

The user may input a confirmation command for coupling the washing rod 120 through the control panel 70 or the external mobile device 2. Based on an input of the confirmation command for coupling the washing rod 120, the washing machine 1 may be in a standby state until the washing rod 120 is coupled to the pulsator 110.

As another example, in a state where the pulsator 110 and the washing rod 120 are decoupled and the other washing modes except for the fifth mode, the sixth mode and the seventh mode are highlighted, the third mode that does not require a use of the washing rod 120 may be selected. In this case, because the third mode suitable for a decoupled state of the washing rod 120 has been selected, the display 73 of the control panel 70 may display information about the third mode without displaying guide information.

Figure 11:
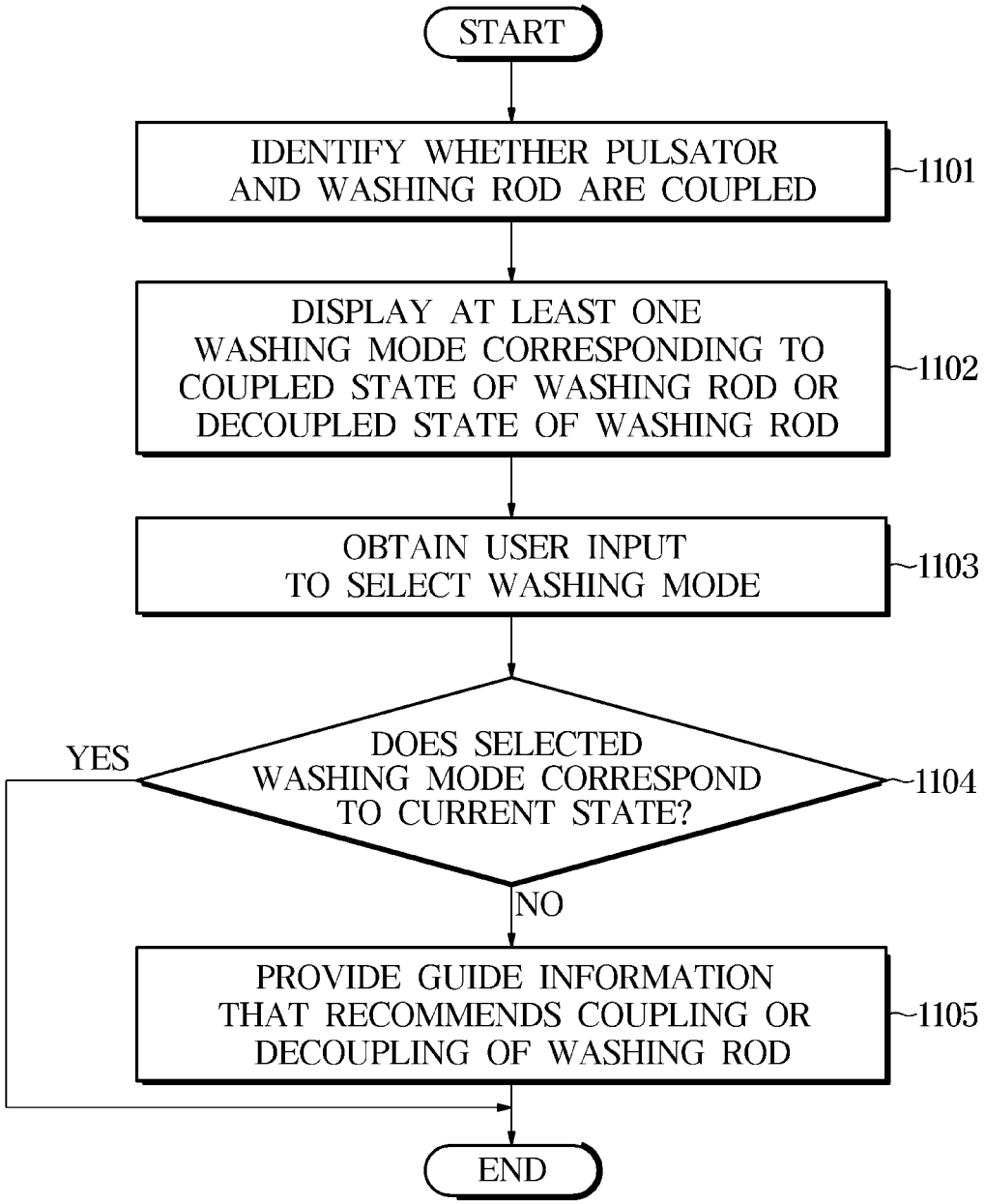
FIG. 11 is a flowchart illustrating a method of controlling a washing machine according to an embodiment of the disclosure.
Figure 12:
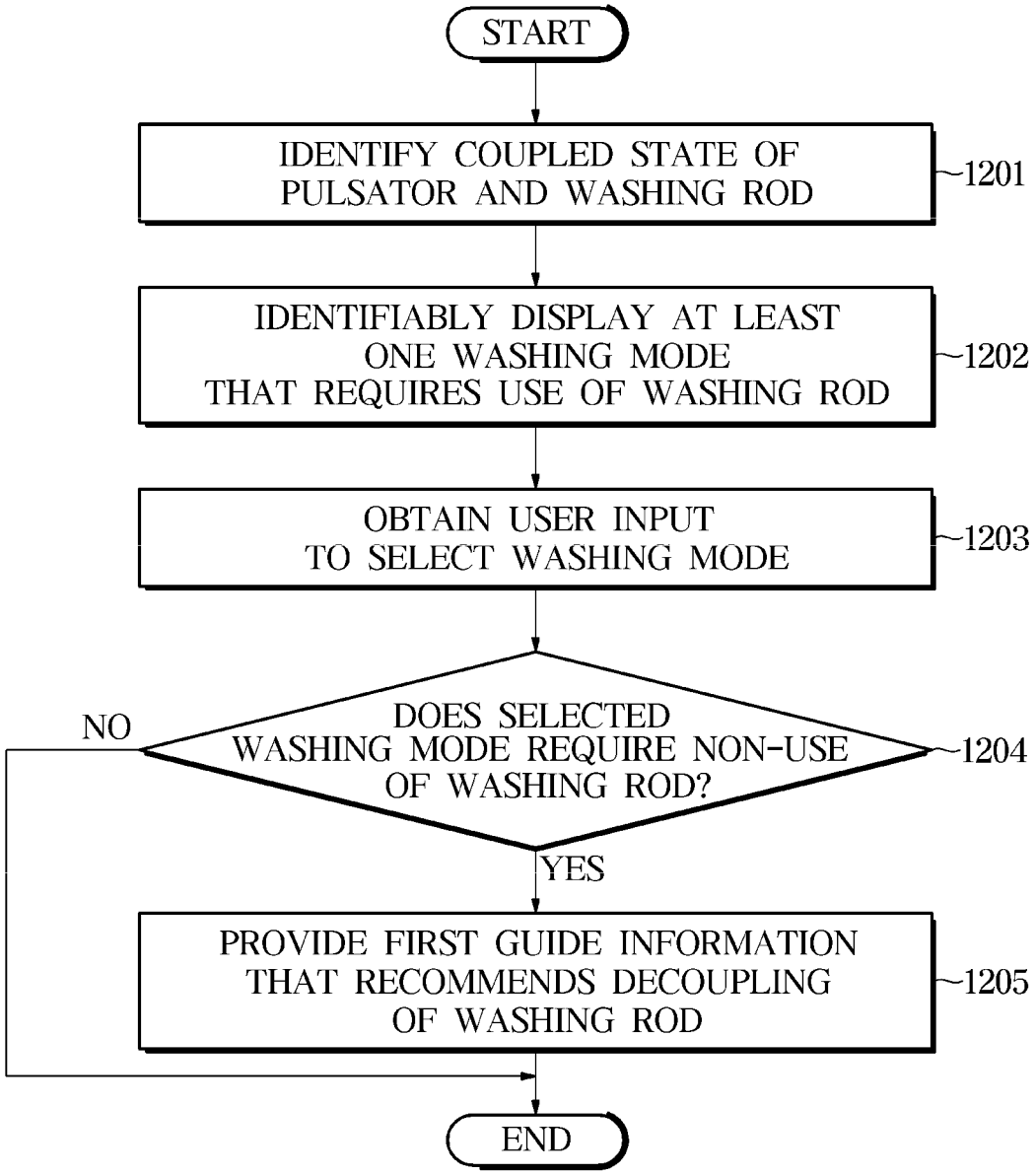
FIG. 12 and FIG. 13 are flowcharts illustrating the method of FIG. 11 in more detail.
Figure 13:
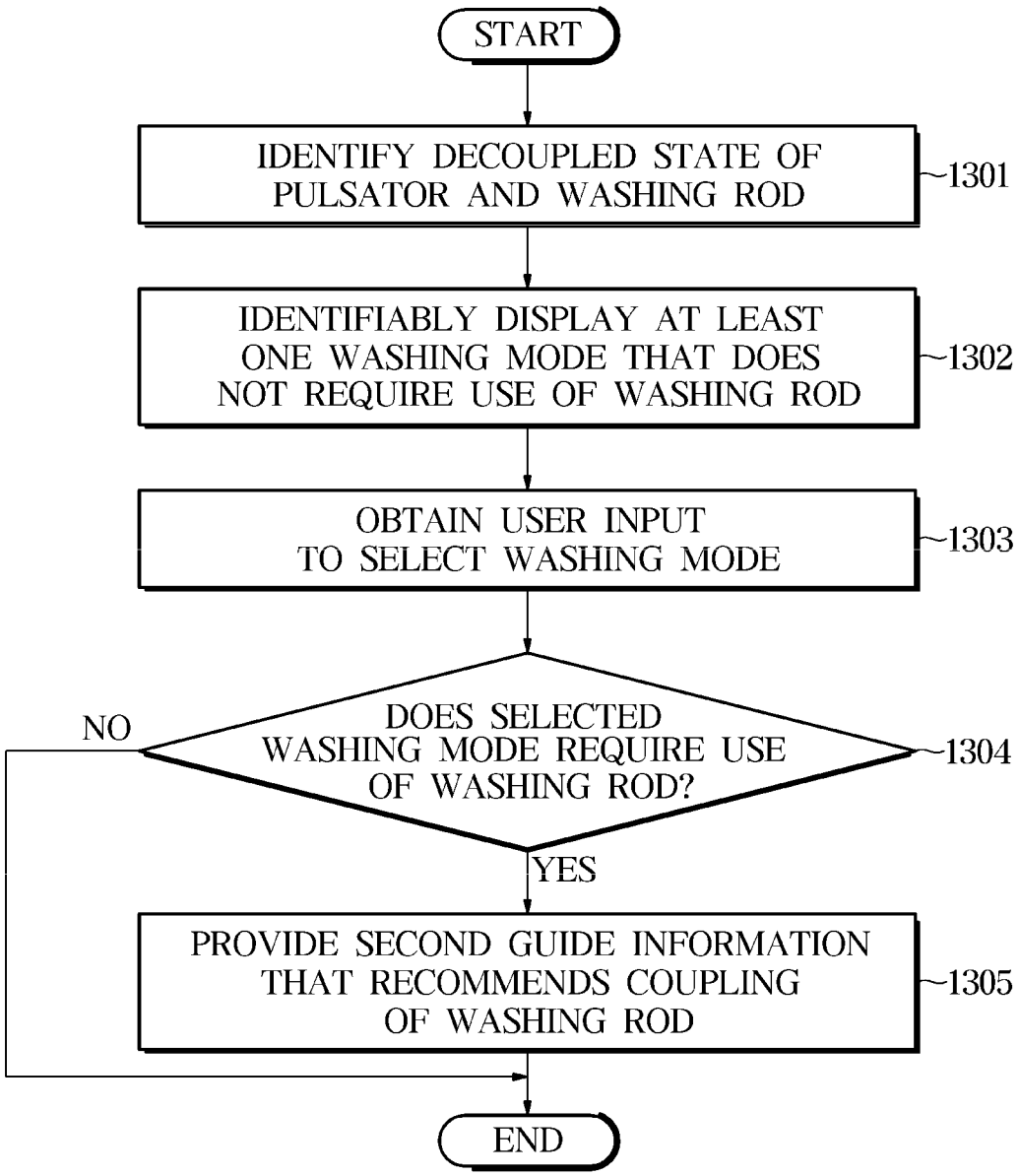

FIG. 11 is a flowchart illustrating a method of controlling a washing machine according to an embodiment of the disclosure. FIG. 12 and FIG. 13 are flowcharts illustrating the method of FIG. 11 in more detail.

Referring to FIG. 11, the controller 400 of the washing machine 1 may identify whether the pulsator 110 and the washing rod 120 are coupled based on a signal transmitted from the washing rod sensor 210 (1101). The controller 400 may control the control panel 70 to display at least one washing mode corresponding to a coupled state of the washing rod 120 or a decoupled state of the washing rod 120 from among a plurality of washing modes M (1102). The at least one washing mode may be displayed through the external mobile device 2.

The controller 400 may obtain a user input to select one of the plurality of washing modes M through the control panel 70 or the external mobile device 2 (1103). The controller 400 may determine whether the washing mode selected by the user input corresponds to a current state of the pulsator 110 and the washing rod 120 (1104). When the washing mode selected by the user input does not correspond to the current state of the pulsator 110 and the washing rod 120, the controller 400 may control the control panel 70 to display provide guide information that recommends coupling or decoupling of the washing rod 120 (1105). Also, the controller 400 may control the communication interface 300 to transmit the guide information to the external mobile device 2.

Referring to FIG. 12, the controller 400 may identify a coupled state of the pulsator 110 and the washing rod 120 (1201). The controller 400 may control the control panel 70 to identifiably display at least one first washing mode that requires use of the washing rod 120 based on the coupled state of the washing rod 120 (1202). The controller 400 may obtain a user input to select one of the plurality of washing modes M (1203). Based on the selected washing mode that does not requires a use of the washing rod 120, the controller 400 may control the control panel 70 to display first guide information that recommends decoupling of the washing rod 120 (1204, 1205).

Referring to FIG. 13, the controller 400 may identify a decoupled state of the pulsator 110 and the washing rod 120 (1301). The controller 400 may control the control panel 70 to identifiably display at least one second washing mode that does not require a use of the washing rod 120 based on the decoupled state of the washing rod 120 (1302). The controller 400 may obtain a user input to select one of the plurality of washing modes M (1303). Based on the selected washing mode requiring the use of the washing rod 120, the controller 400 may control the control panel 70 to display second guide information that recommends coupling of the washing rod 120 (1304, 1305).

Figure 14:
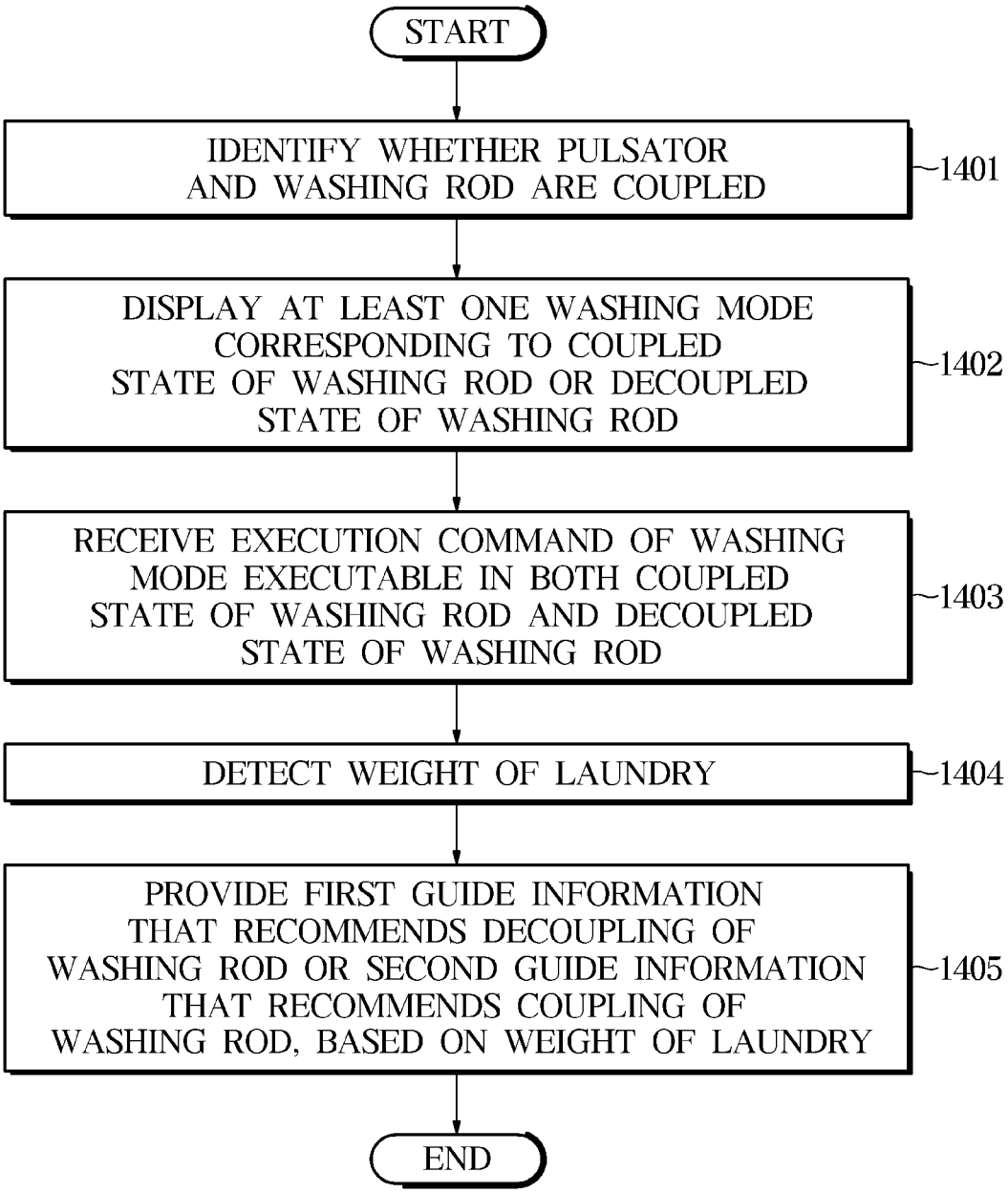
FIG. 14 is a flowchart illustrating a method of controlling a washing machine according to another embodiment of the disclosure.
Figure 15:
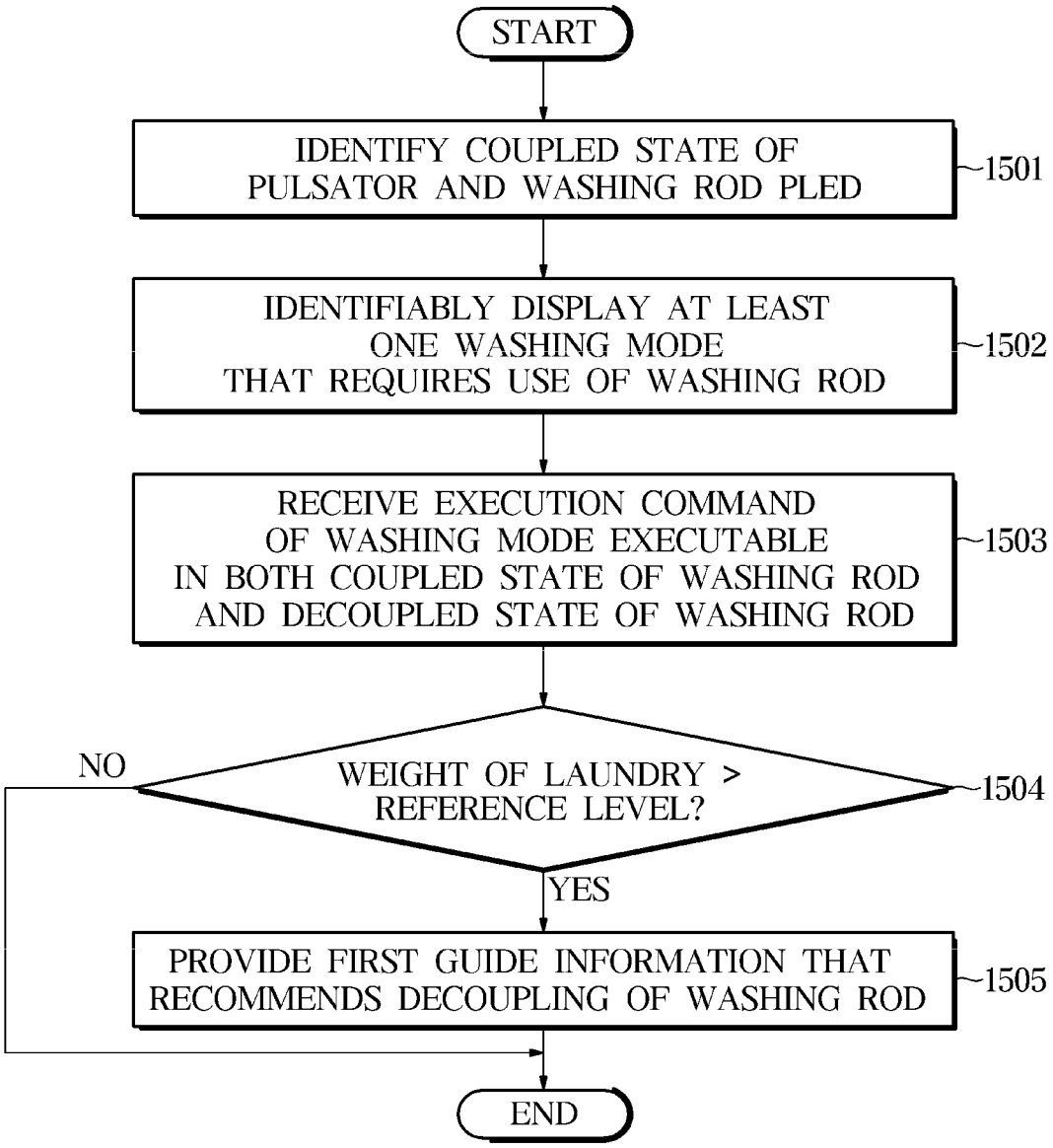
FIG. 15 and FIG. 16 are flowcharts illustrating the method of FIG. 14 in more detail.
Figure 16:
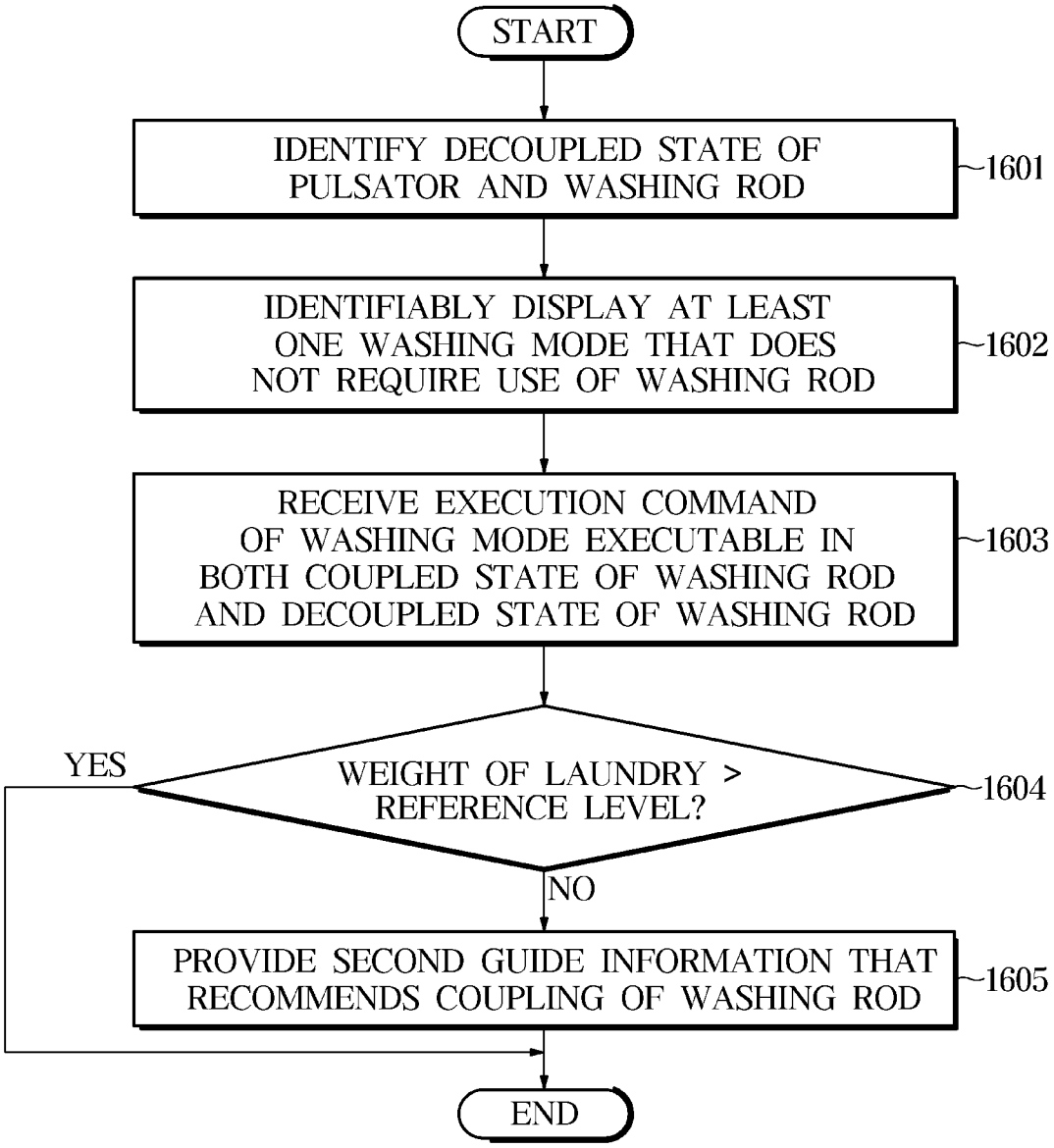

FIG. 14 is a flowchart illustrating a method of controlling a washing machine according to another embodiment of the disclosure. FIG. 15 and FIG. 16 are flowcharts illustrating the method of FIG. 14 in more detail.

Referring to FIG. 14, the controller 400 of the washing machine 1 may identify whether the pulsator 110 and the washing rod 120 are coupled based on a signal transmitted from the washing rod sensor 210 (1401). The controller 400 may control the control panel 70 to display at least one washing mode corresponding to a coupled state of the washing rod 120 or a decoupled state of the washing rod 120 from among a plurality of washing modes M (1402).

The controller 400 may receive an execution command of a washing mode executable in both the coupled state of the washing rod 120 and the decoupled state of the washing rod 120 through the control panel 70 or the external mobile device 2 (1403). Based on the execution command of the washing mode, which is executable in both the coupled state of the washing rod 120 and the decoupled state of the washing rod 120, the controller 400 may detect a weight and/or the amount of laundry accommodated in the rotating tub 12 (1404).

The controller 400 may control the control panel 70 to provide first guide information that recommends decoupling of the washing rod 120 or second guide information that recommends coupling of the washing rod 120, based on the weight of the laundry (1405). The first guide information or the second guide information may be provided through the external mobile device 2.

Referring to FIG. 15, the controller 400 may identify a coupled state of the pulsator 110 and the washing rod 120 (1501). The controller 400 may control the control panel 70 to identifiably display at least one first washing mode that requires use of the washing rod 120 based on the coupled state of the washing rod 120 (1502). The controller 400 may obtain a user input to select one of the plurality of washing modes M. The controller 400 may receive an execution command of a washing mode executable in both the coupled state of the washing rod 120 and the decoupled state of the washing rod 120 (1503). Based on a weight of the laundry detected in the coupled state of the washing rod 120 exceeding a predetermined reference level, the controller 400 may control the control panel 70 to display first guide information that recommends decoupling of the washing rod 120 (1504, 1505).

Referring to FIG. 16, the controller 400 may identify a decoupled state of the pulsator 110 and the washing rod 120 (1601). The controller 400 may control the control panel 70 to identifiably display at least one second washing mode that does not require a use of the washing rod 120 based on the decoupled state of the washing rod 120 (1602). The controller 400 may obtain a user input to select one of the plurality of washing modes M. The controller 400 may receive an execution command of a washing mode executable in both the coupled state of the washing rod 120 and the decoupled state of the washing rod 120 (1603). Based on a weight of the laundry detected in the decoupled state of the washing rod 120 being equal to or less than a predetermined reference level, the controller 400 may control the control panel 70 to display second guide information that recommends coupling of the washing rod 120 (1604, 1605).

As is apparent from the above, the disclosed washing machine and the method of controlling the same can guide a user to use a suitable washing mode in response to coupling or decoupling of a pulsator and a washing rod.

The disclosed washing machine and the method of controlling the same can set a washing mode suitable for a coupled state or a decoupled state of a pulsator and a washing rod, and guide a user on coupling or decoupling of the washing rod according to selection of a washing mode. Thus, convenience of use of the washing machine and a washing efficiency can be improved.

Meanwhile, the disclosed embodiments may be implemented in the form of a recording medium that stores instructions executable by a computer. The instructions may be stored in the form of program codes, and when executed by a processor, the instructions may create a program module to perform operations of the disclosed embodiments. The recording medium may be implemented as a computer-readable recording medium.

The computer-readable recording medium may include all kinds of recording media storing instructions that can be interpreted by a computer. For example, the computer-readable recording medium may be read only memory (ROM), random access memory (RAM), a magnetic tape, a magnetic disc, a flash memory, an optical data storage device, etc.

Also, the computer-readable recording medium may be provided in the form of a non-transitory storage medium, wherein the term 'non-transitory storage medium' simply means that the storage medium is a tangible device, and does not include a signal (e.g., an electromagnetic wave), but this term does not differentiate between where data is semi-permanently stored in the storage medium and where the data is temporarily stored in the storage medium. For example, a 'non-transitory storage medium' may include a buffer in which data is temporarily stored.

According to an embodiment of the disclosure, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloadable or uploadable) online via an application store (e.g., Play Store™) or between two user devices (e.g., smart phones) directly. When distributed online, at least part of the computer program product (e.g., a downloadable app) may be temporarily generated or at least temporarily stored in the machine-readable storage medium, such as a memory of the manufacturer's server, a server of the application store, or a relay server.

Although embodiments have been described for illustrative purposes, those skilled in the art will appreciate that various modifications, additions and substitutions are possible, without departing from the scope and spirit of the disclosure. Therefore, embodiments have not been described for limiting purposes.

What is claimed is:

1. A washing machine, comprising:

a tub;

a rotating tub configured to be rotatable in the tub;

a pulsator configured to be rotatable in a lower portion of the rotating tub;

a washing rod configured to be coupled to the pulsator;

a sensor configured to detect coupling or decoupling of the washing rod to the pulsator, and to transmit a detection signal based on the coupling or the decoupling of the washing rod to the pulsator;

a control panel configured to display a plurality of washing modes; and a controller configured to be electrically connected to the sensor and the control panel, wherein the controller is configured to:

control the control panel to display at least one washing mode corresponding to a coupled state of the washing rod to the pulsator or a decoupled state of the washing rod to the pulsator among the plurality of washing modes based on the transmitted detection signal from the sensor, wherein the controller is configured to:

detect a weight of laundry accommodated in the rotating tub, based on an input of an execution command of a washing mode executable in the coupled state of the washing rod and the decoupled state of the washing rod from among the at least one washing mode, and control the control panel to display first guide information that recommends the decoupling of the washing rod or second guide information that recommends the coupling of the washing rod, based on whether the detected weight of the laundry exceeds a reference level.

2. The washing machine of claim 1, wherein the controller is configured to control the control panel to display at least one first washing mode that requires a use of the washing rod, based on the transmitted detection signal from the sensor.

3. The washing machine of claim 2, wherein the controller is configured to control the control panel to display guide information that recommends the decoupling of the washing rod, based on a second washing mode that does not require the use of the washing rod being selected by a user input, in the coupled state of the washing rod.

4. The washing machine of claim 1, wherein the controller is configured to control the control panel to display other washing modes other than at least one first washing mode among the plurality of washing modes that requires a use of the washing rod, based on the decoupled state of the washing rod.

5. The washing machine of claim 4, wherein the controller is configured to control the control panel to display guide information that recommends the coupling of the washing rod, based on one of the at least one first washing mode being selected by a user, in the decoupled state of the washing rod.

6. The washing machine of claim 1, wherein the controller is configured to control the control panel to display the first guide information, based on the detected weight of the laundry detected in the coupled state of the washing rod exceeding the reference level.

7. The washing machine of claim 1, wherein the controller is configured to control the control panel to display the second guide information, based on the detected weight of the laundry detected in the decoupled state of the washing rod being equal to or less than the reference level.

8. The washing machine of claim 1, further comprising:

a motor configured to rotate the rotating tub, wherein the controller is configured to control the motor so that the rotating tub rotates to move the laundry to a side wall of the rotating tub, based on the coupling or the decoupling of the washing rod being determined based on the detected weight of the laundry.

9. The washing machine of claim 1, further comprising:

a communication interface configured to communicate with an external mobile device, wherein the controller is configured to control the communication interface to transmit display information about the at least one washing mode to the external mobile device.

10. The washing machine of claim 1, wherein the washing rod includes an identifier, and the sensor is configured to detect the coupling or decoupling of the washing rod to the pulsator based on the detection of the identifier.

11. The washing machine of claim 10, wherein:

the identifier includes a magnet;

the sensor includes a magnet sensor configured to detect a magnetic force generated by the magnet of the pulsator; and in response to detecting the generated magnetic force, the sensor is configured to transmit the detection signal to the controller.

12. The washing machine of claim 10, wherein:

the sensor includes a light sensor configured to emit a light and receive the light reflected from the identifier; and in response to detecting the reflected light, the sensor is configured to transmit the detection signal to the controller.

13. A method of controlling a washing machine including a control panel configured to display a plurality of washing modes, the method comprising:

detecting, by a sensor, coupling or decoupling of a washing rod and a pulsator;

transmitting, by the sensor, a detection signal to a controller based on the coupling or the decoupling of the washing rod to the pulsator; and controlling, by the controller, the control panel to display at least one washing mode corresponding to a coupled state of the washing rod to the pulsator or a decoupled state of the washing rod to the pulsator among the plurality of washing modes based on the transmitted detection signal;

detecting a weight of laundry accommodated in a rotating tub, based on an input of an execution command of a washing mode executable in the coupled state of the washing rod and the decoupled state of the washing rod from among the at least one washing mode, and controlling the control panel to display first guide information that recommends the decoupling of the washing rod or second guide information that recommends the coupling of the washing rod, based on whether the detected weight of the laundry exceeds a reference level.

14. The method of claim 13, wherein the controlling of the control panel comprises displaying at least one first washing mode related to a use of the washing rod, based on the transmitting of the detection signal.

15. The method of claim 14, wherein the controlling of the control panel further comprises displaying guide information that recommends the decoupling of the washing rod, based on a second washing mode which does not requires the use of the washing rod being selected by a user, in the coupled state of the washing rod.

16. The method of claim 13, wherein the controlling of the control panel comprises displaying other washing modes other than at least one first washing mode that requires a use of the washing rod, based on the decoupled state of the washing rod.

17. The method of claim 16, wherein the controlling of the control panel further comprises displaying guide information that recommends the coupling of the washing rod, based on one of the at least one first washing mode being selected by a user, in the decoupled state of the washing rod.

18. The method of claim 13, wherein the controlling of the control panel comprises displaying the first guide information, based on the detected weight of the laundry detected in the coupled state of the washing rod exceeding the reference level.

19. The method of claim 13, wherein the controlling of the control panel comprises displaying the second guide information, based on the detected weight of the laundry detected in the decoupled state of the washing rod being equal to or less than the reference level.

20. The method of claim 13, further comprises controlling a motor so that the rotating tub rotates to move the laundry to a side wall of the rotating tub, based on the coupling or the decoupling of the washing rod being determined based on the detected weight of the laundry.

* * * * *